US006457222B1

(12) United States Patent
Torii et al.

(10) Patent No.: US 6,457,222 B1
(45) Date of Patent: Oct. 1, 2002

(54) METHOD OF MANUFACTURING INK JET PRINT HEAD

(75) Inventors: Takuji Torii; Nobuhiro Noto; Keiji Watanabe; Yoshitaka Akiyama; Kenichi Kugai; Nobuhiro Kurosawa; Shigenori Suematsu; Yasuo Takano, all of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/577,945

(22) Filed: May 25, 2000

(30) Foreign Application Priority Data

May 28, 1999 (JP) ..... 11-149522
Mar. 21, 2000 (JP) ..... 2000-077740

(51) Int. Cl.[7] ..... B41J 2/045
(52) U.S. Cl. ..... 29/25.35; 347/68
(58) Field of Search ..... 29/25.35; 347/40, 347/68, 71, 72

(56) References Cited

U.S. PATENT DOCUMENTS 5,311,219 A * 5/1994 Ochiai et al. ..... 347/68
5,755,019 A * 5/1998 Naka et al. ..... 29/25.35
5,761,783 A * 6/1998 Osawa et al. ..... 29/25.35
5,971,522 A * 10/1999 Ono et al. ..... 347/40
6,073,321 A * 6/2000 Kitahara et al. ..... 29/25.35
6,106,106 A * 8/2000 Nakazawa et al. ..... 347/68

FOREIGN PATENT DOCUMENTS

JP 11-58749 3/1999

* cited by examiner

*Primary Examiner*—Lesley D. Morris
*Assistant Examiner*—Eric Keasel
(74) *Attorney, Agent, or Firm*—Whitham, Curtis & Christofferson, PC

(57) ABSTRACT

During a method for manufacturing an ink-jet print head, piezoelectric element bars are fixed to a base plate. Then, two corners of the piezoelectric element bars are cut. The bare are then diced to be separated into individual piezoelectric elements.

28 Claims, 11 Drawing Sheets

METHOD OF MANUFACTURING INK JET PRINT HEAD

BACKGROUND OF THE INVENTION

1. Field of the Invention

The present invention relates to a method of manufacturing an on-demand type multi-nozzle ink jet print head that is mounted in an ink jet printer for industrial and office uses.

2. Description of Related Art

There has been proposed a multi-nozzle ink jet print head that has a number of nozzles arranged with a high density and that employs a piezoelectrlc element to drive each nozzle.

SUMMARY OF THE INVENTION

In a conceivable ink jet print head of the piezoelectric type, a pressure chamber in provided to store ink therein. A diaphragm is provided as being exposed to the pressure chamber. A piezoelectric element is attached to the diaphragm. The piezoelectric element repeatedly expands and shrinks, whereby the diaphragm displaces repeatedly. The diaphragm generates a pressure variation in the pressure chamber, thereby allowing an ink droplet to be ejected from the pressure chamber through its orifice.

It is easy to control the displacement of the diaphragm and to change the amount of ink ejected. However, the piezoelectric element can displace the diaphragm only by a small amount in response to a unit amount of electric voltage. It is therefore necessary to make large the surface area of the diaphragm exposed in the pressure chamber. It is impossible to decrease the nozzle pitch to as small a 140 $\mu$m. Because the driving frequency depends on the shape of the piezoelectric element, the driving frequency can be increased to 20 kHz or more. The ink jet print head of the piezoelectric type can therefore enhance printing speed.

The conceivable ink jet print head of the piezoelectric type will be described below in greater detail with reference to FIG. 1.

The conceivable multi-nozzle ink-jet print head 200 includes a plurality of nozzle rows which are arranged in a predetermined direction X. In each nozzle row, a plurality of nozzles are arranged in a predetermined direction Y which is perpendicular to the direction X. For each nozzle, the ink-jet print head has a pressure chamber 202 that stores ink and that has an orifice 201 to eject ink droplets onto an image recording medium, such as a sheet of paper (not shown), which is positioned confronting the orifice 201. The ink-jet print head 200 has a manifold 208, in correspondence with each nozzle row, for supplying ink to all the pressure chambers 202 that reside in the nozzle row. Each manifold 208 extends in the predetermined direction Y. Each pressure chamber 202 is in fluid communication, via a corresponding restrictor channel 207, to the corresponding manifold 208. The ink-jet print head 200 has a plurality of piezoelectric elements 204 in one to one correspondence with the plurality of pressure chambers 202. A single diaphragm 203 is connected, via elastic material (silicone adhesive material, for example) 209, to the top surfaces 218 of all the plurality of piezoelectric elements 204. The diaphragm 203 is exposed to each pressure chamber 202 in its surface that is opposed to the surface, where the diaphragm 203 is attached to the top surface 218 of the corresponding piezoelectric element 204.

More specifically, the ink-jet print head 200 has a single base plate (piezoelectric element-fixing plate) 206. The plurality of piezoelectric elements 204 are fixedly mounted on the base plate 206. The piezoelectric elements 204 are arranged in the plurality of nozzle rows. The plurality of nozzle rows are arranged in the predetermined direction X, with each nozzle row extending in the predetermined direction Y. Each piezoelectric element 204 has a pair of external electrodes 214*a* and 214*b* at their side surfaces 220*a* and 220*b*. A manifold-forming assembly 280 is provided over the piezoelectric elements 204 to provide the manifolds 208.

A single support plate 213 is mounted over both the manifold-forming assembly 280 and the piezoelectric elements 204 in order to reinforce the diaphragm 203. The support plate 213 is formed with a plurality of openings 217*a* in one to one correspondence with the plurality of piezoelectric elements 204. The diaphragm 203 is mounted over the support plate 213. The diaphragm 203 has a plurality of oscillating areas 230 that are exposed through the corresponding openings 217*a* to confront the top surfaces 218 of the plurality of piezoelectric elements 204. Substantially the central portions of the oscillating areas 230 are connected via elastic material 209 to the top surfaces 218 of the piezoelectric elements 204.

A restrictor plate 210 is mounted over the diaphragm 203 to provide a restrictor channel 207 for each piezoelectric element 204. A pressure chamber plate 211 is mounted over the restrictor plate 210 to provide a pressure chamber 202 for each piezoelectric element 204. A nozzle plate 212 is mounted over the chamber plate 211 to provide an orifice 201 to each pressure chamber 202.

With the above-described structure, electric signals are repeatedly applied to the external electrodes 214*a* and 214*b* of each piezoelectric element 204 via input signal terminals 205*a* and 205*b*. As a result, electric potentials repeatedly occur between the external electrodes 214*a* and 214*b*, and the piezoelectric element 204 repeatedly expands and shrinks in a direction substantially normal to the surface of the base plate 206. The oscillating area 230 of the diaphragm 203, that is connected to the top surface 218 of the piezoelectric element 4, oscillates in directions near to and away from the orifice 201, thereby producing pressure variations in the pressure chamber 202. Ink droplets are ejected from the pressure chamber 202 via the orifice 201. Thus, the piezoelectric element 204 and the corresponding oscillating area 230 in the diaphragm 203 cooperate to serve as an oscillating system.

It is conceivable that the ink-jet print head 200 halving the above-described structure be manufactured in a manner described below.

A plurality of bar- or rod-shaped original piezoelectric elements (which will be referred to as "piezoelectric element bars", hereinafter) are first prepared. The number of the piezoelectric element bars is equal to the total number of nozzle rows to be mounted in the print head 200. Each piezoelectric element bar has a top surface 218 and toe pair of slia surfaces 220*a* and 220*b* which are provided with the pair of external electrodes 214*a* and 214*b*, respectively. Each piezoelectric element bar is cut at their two corners 215*a* and 215*b* which are defined between the top surface 218 and the side surfaces 220*a* and 220*b*. This corner-cutting operation is required to prevent the external electrodes 214*a* and 214*b* from being short-circuited to the diaphragm 203 when the diaphragm 203 is bonded to the top surface 218 and also to ensure sufficient amounts of margin in relative positions between the oscillating areas 230 of the diaphragm 203 and the top surfaces 208 of the piezoelectric elements 204. For example, a grinder is pressed against each corner 215*a*, 215*b* of each piezoelectric element 204, thereby beveling the corner 215*a,* 215*b.*

After being subjected to the corner-cutting process, all the piezoelectric element bars are arranged on the base plate 206 in the predetermined direction X so that each piezoelectric element bar extends in the predetermined direction Y. Then, the piezoelectric element bars are bonded to the base plate 206. Each piezoelectric element bar is then subjected to a dicing process, in which each piezoelectric element bar is cut into a plurality of individual piezoelectric elements 204 along the predetermined direction Y. This dicing process is performed using a dicing saw.

Thus, in the above-described conceivable production steps, each piezoeloctric element bar is first cut at their corners 215*a* and 215*b,* is attached to the base plate 206, and then is finally diced into the plurality of piezoelectric elements 204.

During these production steps, there are several factors that will possibly reduce the processing precision.

First, because each piezoelectric element bar is made of ceramic, the piezoelectric element bar is sintered during its production process. During the sintering process, the piezoelectric element bar deforms and thermally expands. It is therefore difficult to control the width of the piezoelectric element bar uniformly over its entire length. Variations occur in the width of each piezoelectric element bar.

During the corner-cutting process, variations will also occur in the cut widths of the corners 215*a* and 215*b.* In this case, the processing precision will become low. If the piezoelectric element bar having large variations in its corner-cutting width is bonded to the base plate 206, there will occur large amounts of errors in the position where the piezoelectric element bar is attached to the base plate 206.

When the piezoelectric element bar thus fixed to the base plate 206 with large positional errors is divided into the individual piezoelectric elements 204 and assembled with the diaphragm 203, the center of the top surface 218 of each piezoelectric element 204 will possibly shift from the center of a corresponding oscillating area 230 of the diaphragm 203. As a result, the amount of spring modulus, at which the oscillating area 230 of the diaphragm 203 will oscillate, differentiates among respective nozzles. The ink ejecting characteristic will differentiate among respective nozzles. The amounts of ink to be ejected from respective nozzles will therefore change among the respective nozzles.

In view of the problems described above, it is an object of the present invention to provide an improved method of manufacturing an ink jet print head to reduce the variations in the amounts of ink to be ejected from respective nozzles.

In order to attain the above and other objects, the present invention provides a method of manufacturing an ink jet print head which has one or more nozzle rows, each nozzle row including a plurality of nozzles, the ink jet print head having a diaphragm that forms at least a part of a wall defining a pressure chamber storing ink for each nozzle, a wall portion that defines a retaining part of the wall defining the pressure chamber for each nozzle, that defines an ink channel for supplying ink to the pressure chamber, and that defines an orifice for ejecting ink droplets from the pressure chamber, a piezoelectric element, provided for each nozzle, to allow, in response to electric signals, the diaphragm to generate a pressure variation within the corresponding pressure chamber, thereby causing an ink droplet to be ejected from the pressure chamber through the corresponding orifice, and a base plate, on which all the piezoelectric elements, the wall portion, and the diaphragm are mounted, the method comprising the steps of: arranging, while referring to a first reference position that is defined on a base plate, one or more original piezoelectric element bars, in one or more rows, on a surface of the base plate, and bonding the one or more original piezoelectric element bars on the surface of the base plate, the number of the one or more rows corresponding to the number of one or more nozzle rows to be mounted in the ink jet print head, the one or more original piezoelectric element bars being oriented with their lengthwise directions corresponding to an extending direction of each nozzle row and being arranged in their widthwise directions to provide the one or more rows, each row being comprised from at least one original piezoelectric element bar, each original piezoelectric element bar having a top surface for being connected to the diaphragm, a pair of side surfaces, on which a pair of external electrodes being attached, and a bottom surface, at which the subject original piezoelectric element bar is bonded with the base plate; subjecting each original piezoelectric element bar, which is fixed on the base plate, to a corner cutting process by cutting at least one of two corner of the original piezoelectric element bar, while referring to a second reference position that is defined on the base plate, the two corners being defined between its pair of side surfaces and its top surface; and subjecting, after the corner-cutting process, each original piezoelectric element bar, which is fixed to the base plate, to a dividing process by dividing each original piezoelectric element bar, along its lengthwise direction, into a plurality of individual piezoelectric elements, while referring to a third reference position on the base plate, the number of the individual piezoelectric elements corresponding to the number of nozzles to be provided in each row.

The method may further comprise the step of mounting the wall portion and the diaphragm onto the base plate, which is already mounted with the individual piezoelectric elements, while referring to a fourth reference position that is defined on the base plate, and bonding the diaphragm, via an elastic material, to the top surfaces of all the individual piezoelectric elements.

The wall portion may include a support portion reinforcing the diaphragm, the support portion being formed with a plurality of openings for the plurality of nozzles in each nozzle row, the diaphragm being exposed through the plurality of openings, and wherein the mounting and bonding step includes a step of bonding a part of each exposed portion of the diaphragm, via the elastic material, to the top surface of the corresponding individual piezoelectric element mounted on the base plate.

The corner cutting process may be conducted by using a dicing saw, and wherein during the corner cutting process for each original piezoelectric element bar, the dicing saw is moved along the lengthwise direction or the subject original piezoelectric element bar with a distance between the dicing saw and the second reference position being controlled to a corresponding amount, the vertical position of the dicing saw distant from the surface of the base plate being fixed to provide a desired cut depth amount on the corner.

The dividing process may be conducted by using the dicing saw, and wherein during the dividing process, the dicing saw is moved along the widthwise directions of the one or more original piezoelectric element bar and along the surface of the base plate repeatedly, thereby allowing the plurality of individual piezoelectric elements, each having a desired length, to be remained on the base plate.

According to another aspect, the present invention provides a method of manufacturing an int jet print head which has one or more nozzle rows, each nozzle row including a plurality of nozzles, the ink jet print head having a diaphragm that forms at least a part of a wall defining a pressure chamber storing ink for each nozzle, a wall structure that defines an ink channel supplying ink to the pressure chamber for each nozzle, the ink channel including, for each nozzle row, a manifold and a plurality of restrictor channels, the plurality of restrictor channels being in fluid communication with the corresponding manifold and being in fluid communication with the plurality of pressure chambers in the subject nozzle row, each restrictor channel serving as an ink fluid path supplying ink to the corresponding pressure chamber from the corresponding manifold, the wall structure further defining, for each nozzle, an orifice ejecting an ink droplet from the corresponding pressure chamber, a piezoelectric element, provided for each nozzle, to allow, upon application of electric signals, the diaphragm to generate a pressure variation within the corresponding pressure chamber, thereby causing an ink droplet to be ejected from the pressure chamber through the corresponding orifice, the diaphragm being bonded to each piemoelectric element via an elastic material, and a base plate, on which all the piezoelectric elements, the wall structure, and the diaphragm are mounted, the method comprising the steps of: arranging one or more original piezoelectric element bars, in one or more rows, on the base plate and bonding the one or more original piezoelectric element bars to the base plate, the number of the one or more rows corresponding to the number of one or more nozzle rows to be mounted in the ink jet print head, the one or more original piezoelectric element bars being oriented with their lengthwise directions corresponding to an extending direction of each nozzle row and being arranged in their widthwise directions to provide the one or more rows, each original piezoelectric element bar having a top surface for being connected to the diaphragm and a pair of side surfaces, on which a pair of external electrodes being attached; subjecting each original piezoelectric element bar, which is fixed on the base plate, to a corner cutting process by cutting, using a dicing saw, at least one of two corners of the original piezoelectric element bar that are defines by its side surfaces and its top surface, while referring to an arbitrary corner-cut reference position that is defined on the base plate; and subjecting, after the corner-cutting process, each original piezoelectric element bar, which is fixed to the base plate, to a dicing process by dividing each original piezoeloctric element bar, along its lengthwise direction, into a plurality of individual piezoelectric elements, while referring to an arbitrary dividing reference position that is defined on the base plate, the number of the individual piezoelectric elements corresponding to the number of nozzles in each row.

The method may further comprise the step of mounting the wall structure and the diaphragm onto the base plate, which is already mounted with the individual piezoelectric elements, and bonding the diaphragm, via an elastic material, to the top surfaces of all the individual piezoelectric elements.

BRIEF DESCRIPTION OF THE DRAWINGS

In the drawings:

FIG. 5B shows a corner-cutting process, and FIG. 5C shows a piezoelectric element bar-dividing process;

FIG. 8B shows a corner-cutting process, and FIG. 8C shows a piezoelectric element bar-dividing process;

FIGS. 9A and 9B are perspective views showing the manufacturing processes according to another modification, in which FIG. 9A shows a corner-cutting process, and FIG. 9B shows a piezoelectric element bar-dividing process;

FIGS. 10A and 10B are perspective views showing the manufacturing processes according to still another modification, in which FIG. 10A shows a piezoelectric element bar-fixing process, and FIG. 10B shows corner-cutting cutting and piezoelectric element bar-dividing processes; and FIGS. 11A and 11B are perspective views showing the manufacturing processes according to another modification, in which FIG. 11A shows a piezoelectric element bar-fixing process, and FIG. 11B shows corner-cutting and piezoelectric element bar-dividing processes.

DETAILED DESCRIPTION OF THE PREFERRED EMBODIMENT

An ink-jet print head according to a preferred embodiment of the present invention will be described while referring to the accompanying drawings.

Figure 1:
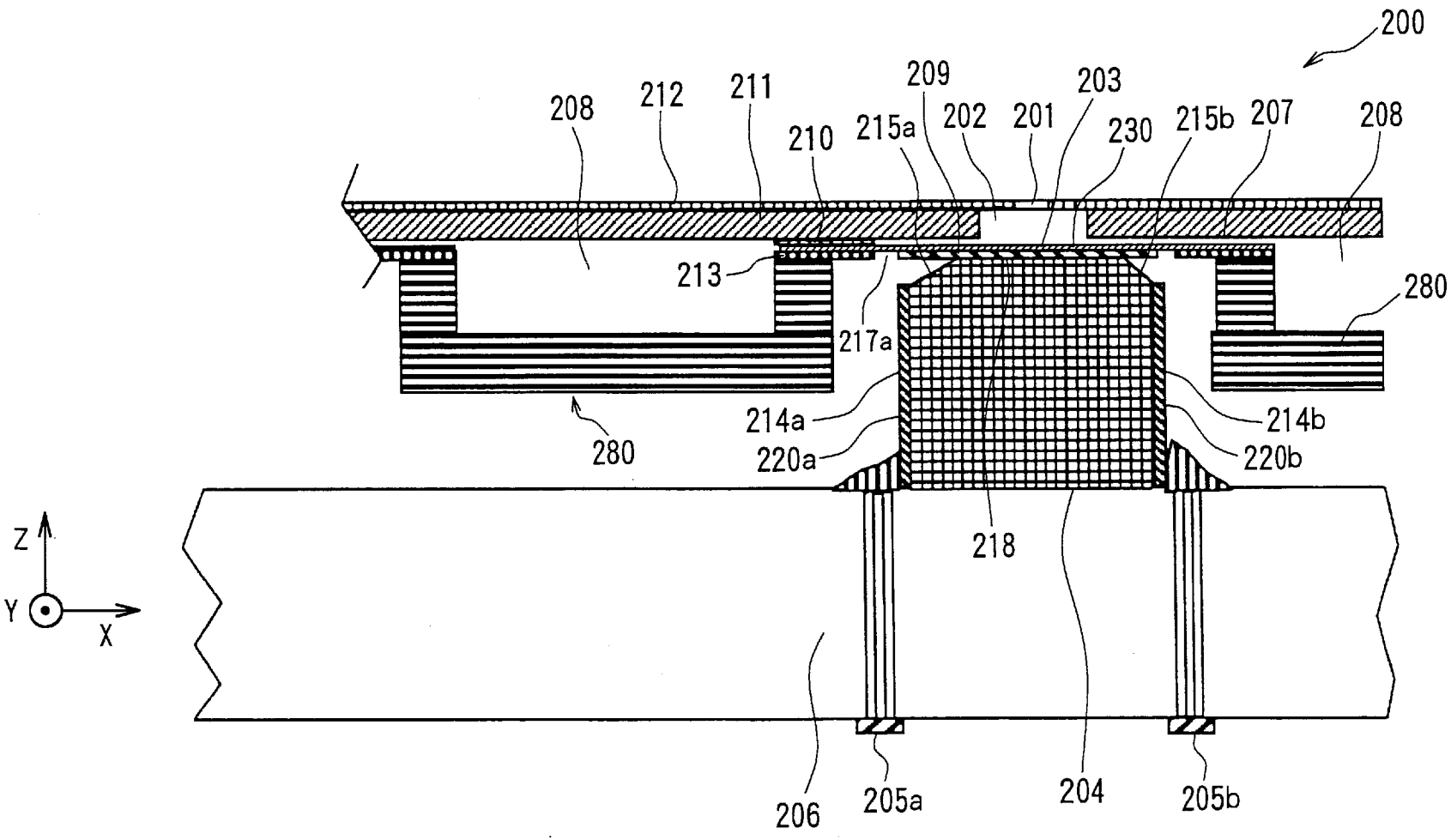
FIG. 1 is a cross-sectional view showing the construction of the nozzle portion in a conceivable multi-nozzle ink-jet print head.
Figure 2A:
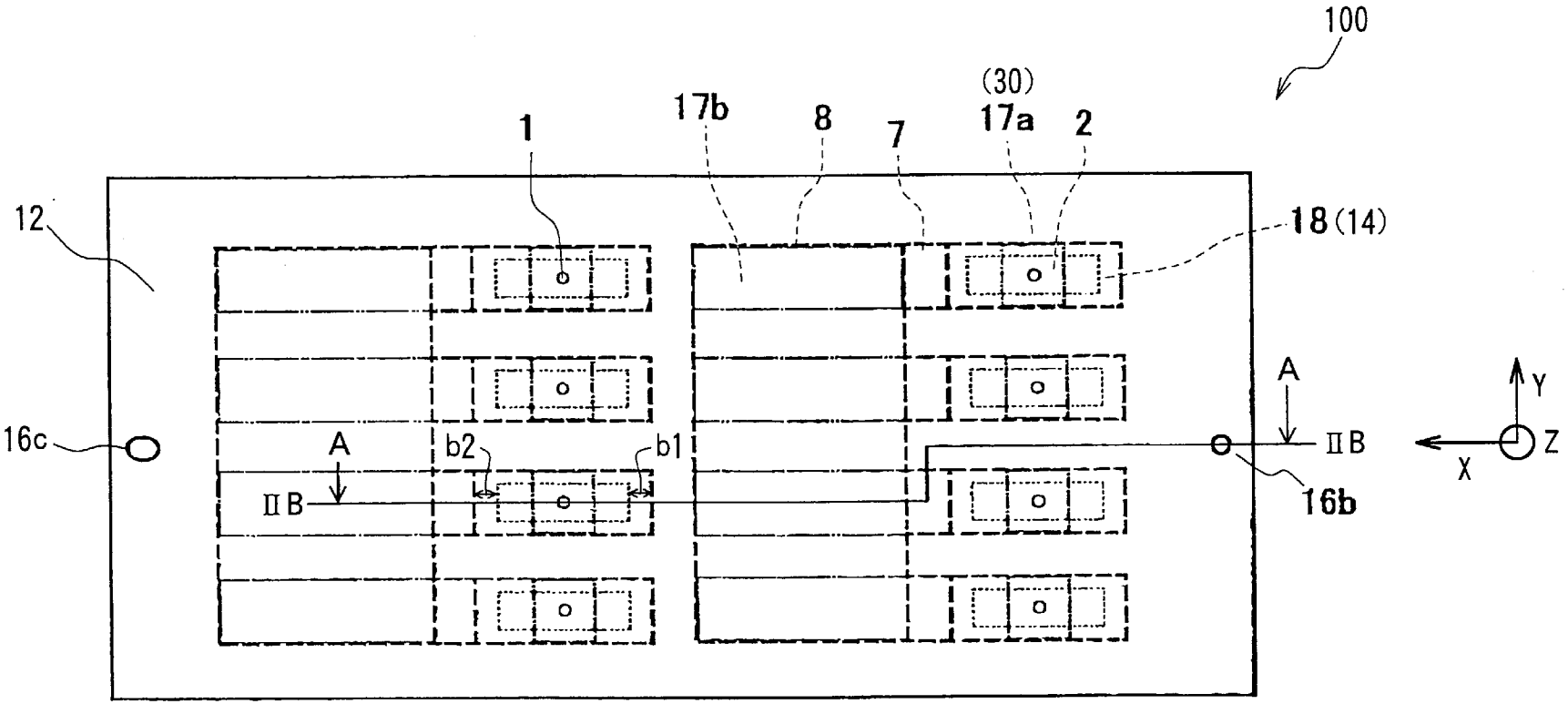
FIG. 2A is a plan view of a multi-nozzle ink-jet print head according to an embodiment of the present invention.
Figure 2B:
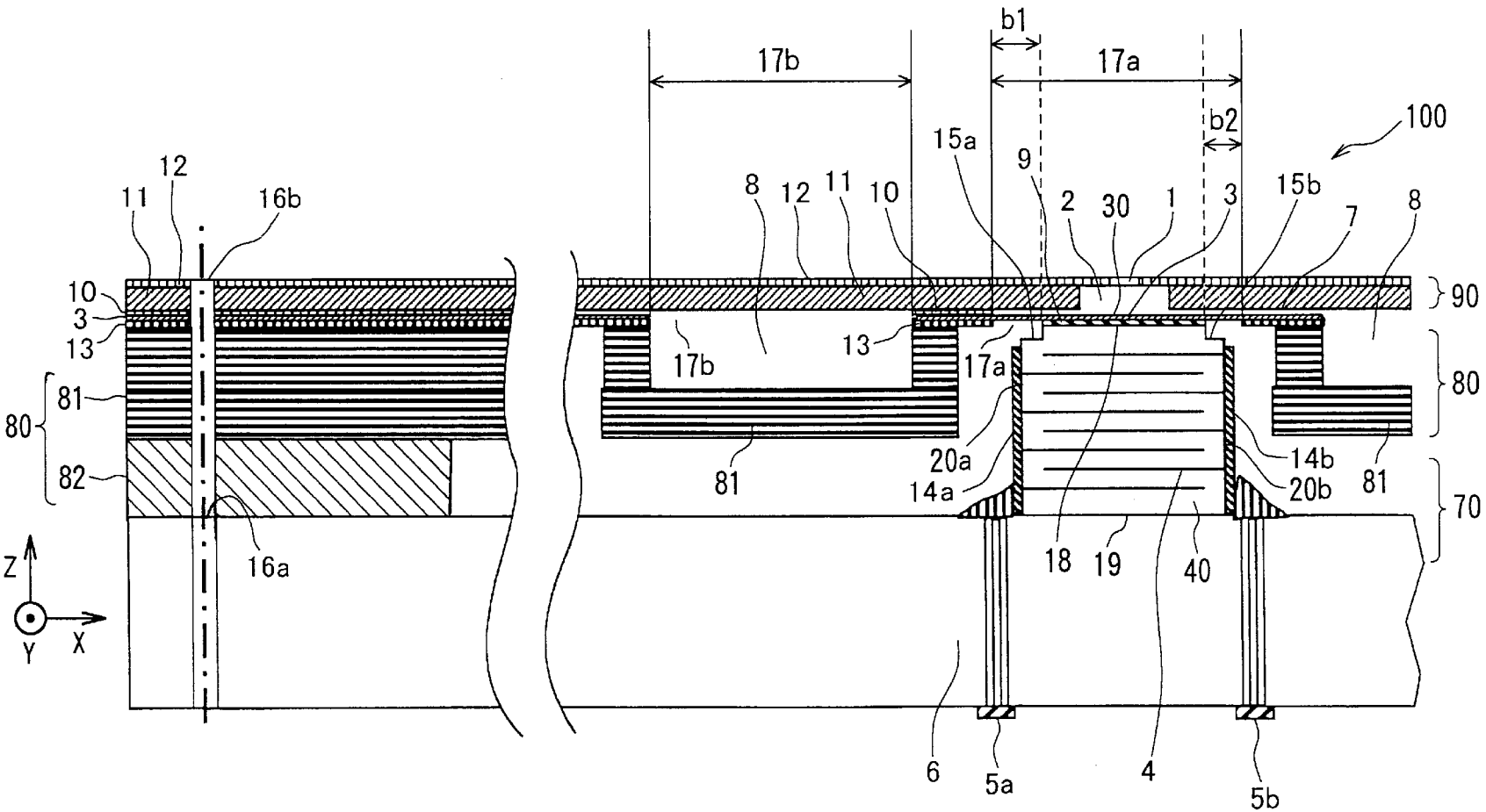
FIG. 2B is a cross-sectional view of the multi-nozzle ink-jet print head of FIG. 2A taken along a line IIB—IIB in FIG. 2A as viewed from an arrow A.

FIG. 2A is a plan view of a multi-nozzle ink-jet print head according to the present embodiment. In FIG. 2A, several parts provided within the multi-nozzle ink-jet print head are indicated by broken line. FIG. 2B is a cross-sectional view of the multi-nozzle ink-jet print head 100 taken along a line IIB—XIB in FIG. 2A as viewed from an arrow A.

As shown in these figures, the multi-nozzle ink-jet print head 100 of this embodiment includes a plurality of nozzles which are arranged in a matrix shape. In this example, the multi-nozzle ink-jet print head 100 is provided with two rows of nozzles, each nozzle row having four nozzles. The nozzle rows are arranged in a predetermined direction X, while each nozzle row extends in a predetermined direction Y that in perpendicular to the predetermined direction X.

The multi-nozzle ink-jet print head has a pressure chamber 2 for each nozzle. The pressure chamber 2 stores ink and has an orifice 1 to eject ink droplets onto an image recording medium, such as a sheet of paper (not shown), that is positioned confronting the orifice 1. The multi-nozzle ink-jet print head 100 further has a manifold 8, in one to one correspondence with each nozzle row, for supplying ink to all the pressure chambers 2 that reside in the nozzle row. Each manifold 8 extends in the predetermined direction Y. Each pressure chamber 2 is in fluid communication, via a corresponding restrictor channel 7, to a corresponding manifold 8.

The multi-nozzle ink-jet print head 100 has a plurality of piezoelectric elements 4 in one to one correspondence with the plurality of pressure chambers 2. A single diaphragm 3 is connected, via an elastic material (silicone adhesive material, for example) 9, to the top surfaces 18 of all the plurality of piezoelectric elements 4. The diaphragm 3 is exposed to each pressure chamber 2 in its surface opposed to the surface where the diaphragm 3 is attached to the top surface 18 of a corresponding piezoelectric element 4.

The structure of the multi-nozzle ink-jet print head 100 will be described below in greater detail.

The multi-nozzle ink-Jet print head 100 has a single base plate (piezoelectric element-fixing plate) 6. The plurality of piezoelectric elements 4 are arranged on a surface of the base plate 6 in a matrix shape as shown in FIG. 5C. In this example, the piezoelectric elements 4 are arranged in two rows. In each row, four piezoelectric elements 4 are arranged in line. The two rows of piezoelectric elements 4 are arranged in the predetermined direction X on the base plate 6, each row extending in the predetermined direction Y. It is noted that a predetermined direction (vertical direction) Z is defined normal to the surface of the base plate 6 and perpendicular both to the predetermined directions X and Y.

Figure 2C:
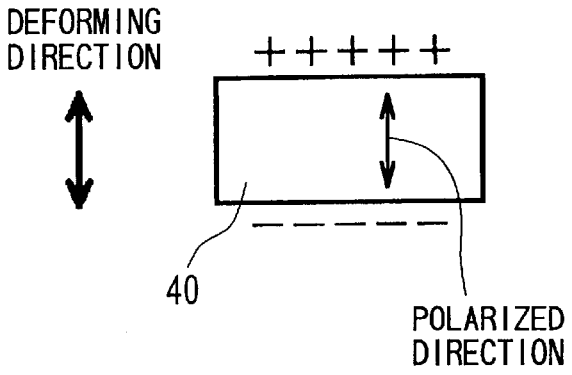
FIG. 2C is a cross-sectional diagram illustrating the structure of one of a plurality of piezoelectric element units 40 that constitute each piezoelectric element 4 mounted in the multi-nozzle ink-jet print head of FIG. 2B.
Figure 2D:
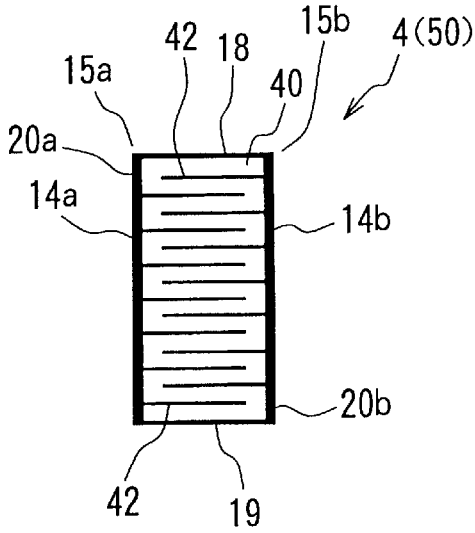
FIG. 2D is a cross-sectional diagram illustrating how each piezoelectric element 4 is constructed from a plurality of piezoelectric element units 40 of FIG. 2C, in which the corners 15*a* and 15*b* of the piezoelectric element are not yet cut.

As shown in FIG. 2B, each piezoelectric element 4 is of a laminated structure, in which a plurality of piezoelectric element units 40 of a d33 type, shown in FIG. 2C, are laid one on another between its bottom surface 19 and its top surface 18. As shown in FIG. 2C. each d33 type piezoelectric element unit 40 is a polarized dielectric material that will deform (expand and shrink) in the same direction with the polarized direction when an electric voltage is applied therethrough in the same direction with the polarized direction. In the piezoelectric element 4, as shown in FIG. 2D, a plurality of the d33 piezoelectric element units 40 are laid one on another with a plurality of internal electrodes 42 being sandwiched therebetween. A pair of external electrodes 14*a* and 14*b* are provided on both of a pair of side surfaces 20*a* and 20*b* of the piezoelectric element 4 in electrical connection with the inner electrodes 42.

As shown in FIG. 2D, corners 15*a* and 15*b* are defined on the piezoelectric element 4 as portions between the top surface 18 and the side surfaces 20*a* and 20*b* where the external electrodes 14*a* and 14*b* are provided. As shown in FIG. 2B, the corners 15*a* and 15*b* are cut so that the external electrodes 14*a* and 14*b* will not electrically contact the diaphragm 3 to be short-circuited with the diaphragm 3. As will be described later, the cutting of the corners 15*a* and 15*b* is performed with reference to a positioning pin hole 16*a* formed in the base plate 6.

As shown in FIG. 2B, a pair of input signal terminals 5*a* and 5*b* are provided on a rear surface of the base plate 6, that is opposed to the surface where the piezoelectric element 4 is mounted. The input signal terminals 5*a* and 5*b* are electrically connected to the external electrodes 14*a* and 14*b*, respectively. Electrical signals are applied to the external electrodes 14*a* and 14*b* via the input signal terminals 5*a* and 5*b*.

A manifold-forming assembly 80 is fixedly mounted to the base plate 6 over the piezoelectric elements 4. The manifold-forming assembly 80 is constructed from several channel-forming plates 81 that define the plurality of (two, in this example) manifolds 8 and a spacer plate 82. Each manifold 8 extends in the predetermined direction Y as shown in FIG. 2A.

Figure 3:
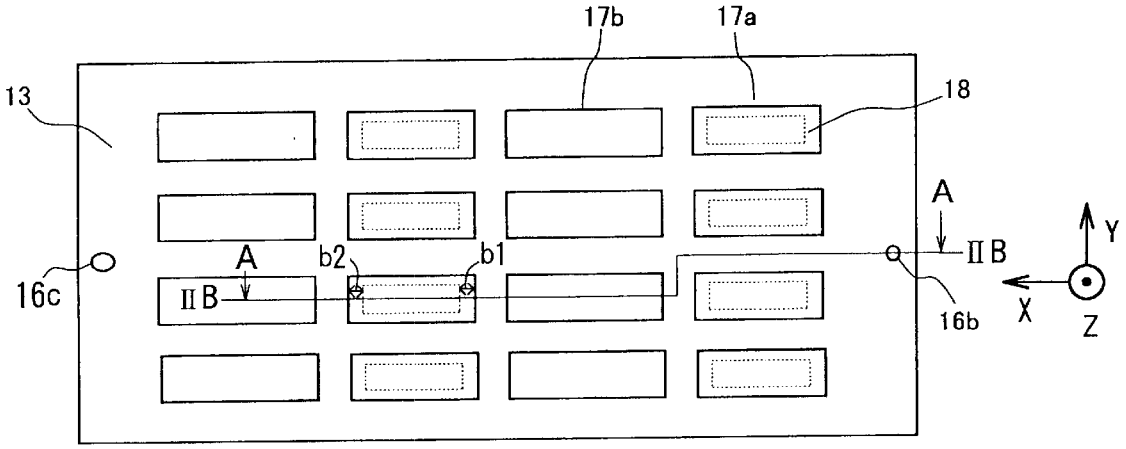
FIG. 3 is a plan view of a support plate that is mounted over the plurality of piezoelectric elements 4 in the multi-nozzle ink-jet print head of FIG. 2B.

A single support plate 13 is provided over both the manifold-forming assembly 80 and the plurality of piezoelectric elements 4. The support plate 13 is for reinforcing the diaphragm 3. As shown in FIGS. 2A, 2B, and 3, the support plate 13 has a plurality of elongated openings 17*a* in one to one correspondence with the plurality of nozzles so that each elongated opening 17*a* receives the top surface 18 of a corresponding piezoelectric element 4. In this example, the support plate 13 has two rows of elongated openings 17*a*, each row having four openings 17*a*. The two rows of elongated openings 17*a* are arranged in the predetermined direction X, each row extending in the predetermined direction Y.

As indicated by the broken line in FIGS. 2A and 3, the support plate 13 is positioned relative to the piezoelectric elements 4 so that the top face 18 of each piezoelectric element 4 is substantially centered in the corresponding elongated opening 17*a* and so that a pair of opposite spaces with widths of b1 and b2 of predetermined values are formed in the subject opening 17*a* on the opposite sides of the piezoelectric element 4 along the predetermined direction X.

The support plate 13 has other two rows of elongated openings 17*b*. Each row has four separate elongated openings 17*b*. All the elongated openings 17*b* in one row are in fluid communication with a corresponding manifold 8. Theoretically, it is unnecessary to separately provide the four elongated openings 17*b* for a single row. All the four elongated openings 17*b* may be formed in the shape of a single opening. However, it is preferable to form the four elongated openings 17*b* in the separate fashion to reinforce the rigidity of the support plate 13.

A single diaphragm 3 is mounted over the support plate 13. The diaphragm 3 has a plurality of oscillating areas 30 in one to one correspondence with the elongated openings 17*a* in the support plate 13. More specifically, each oscillating area 30 is exposed through the corresponding opening 17*a* in the support plate 13 to confront the top surface 18 of one piezoelectric element 4. An elastic material (silicone adhesive material, for example) 9 is provided to connect the top surface 18 of each piezoelectric element 4 with substantially the central region of the corresponding oscillating area 30. Thus, the top surface 18 of each piezoelectric element 4 is connected to the corresponding oscillating area 30 substantially at its central region that is defined as being sandwiched between the pair of opposite spaces with widths of bl and b2 in the opening 17*a*.

With this structure, each oscillating area 30 of the diaphragm 3 will operate as a spring whose spring constant is proportional to the cube of the width b1 and to the cube of the width b2. In order to allow all the nozzles to have the same ink ejection characteristics, the amount of the width b1 should be uniform for all the nozzles and the amount of the width b2 should also be uniform for all the nozzles. It is necessary to control the sizes and the positions of the top surfaces 18 of the piezoelectric elements 4 relative to the sizes and positions of the openings 17*a* to attain the same amounts of widths b1 and the same amounts of widths b2 for all the nozzles.

A single restrictor plate 10 is mounted over the diaphragm 3. The restrictor plate 10 defines the plurality of restrictor channels 7 in one to one correspondence with the plurality of piezoelectric elements 4. The restrictor plate 10 is positioned relative to the manifold-forming assembly 80 so that each restrictor channel 7 is in fluid communication with a corresponding manifold 8. The restrictor channel 7 serves as an ink fluid path for controlling supply of ink from the corresponding manifold 8 to a corresponding pressure chamber 2.

It is noted that the restrictor channel plate 10 is positioned relative to the support plate 13 so that the space with width b2 is located in each opening 17*a* at its one side of the top surface 18 of the piezoelectric element 4 where the corresponding restrictor channel 7 exists, and the other spaces with width b1 is located in the other side of the top surface 18 of the piezoelectric element 4 in the opening 17*a*.

A single pressure chamber plate 11 is provided over the restrictor plate 10. The pressure chamber plate 11 defines the plurality of pressure chambers 2 in one to one correspondence with the plurality of piezoelectric elements 4. The pressure chamber plate 11 is positioned relative to the restrictor channel plate 10 so that each pressure chamber 2 is in liquid communication with a corresponding restrictor channel 7. The pressure chamber plate 11 is positioned relative to the diaphragm 3 and to the support plate 13 so that each pressure chamber 2 is located above the corresponding oscillating area 30 and the corresponding opening 17*a*.

A single nozzle plate 12 is mounted over the pressure chamber plate 11. The nozzle plate 12 is formed with a plurality of orifices 1 in one to one correspondence with the plurality of piezoelectric elements 4. The nozzle plate 12 is positioned relative to the pressure chamber plate 11 so that each orifice 1 is in fluid communication with a corresponding pressure chamber 2.

The diaphragm 3, the restrictor plate 10, the pressure chamber plate 11, and the support plate 13 are all made of stainless steel, for example. The orifice plate 12 is made from nickel material. The base plate 6 is made of insulation material, such as ceriamic, polyimide or the like.

As shown in FIG. 2B, a positioning pin hole 16*a* is formed to the base plate 6. A corresponding positioning pin hole 16*b* is formed to each of the channel-forming plates 81, the spacer plate 82, the support plate 13, the diaphragm 3, the restrictor plate 10, the pressure chamber plate 11, and the orifice plate 12.

As shown in FIG. 5C, another positioning pin hole 16*a*' is provided to the base plate 6. A positioning pin hole 16*c* corresponding to the pin hole 16*a*' is also provided on each of the channel-forming plates 81, the spacer plate 82, the support plate 13, the diaphragm 3, the restrictor plate 10, the pressure chamber plate 11, and the orifice plate 12. The positioning pin holes 16*c* formed in the orifice plate 12 and in the support plate 13 are shown in FIGS. 2A and 3.

The positioning pin holes 16*a* and 16*b* are designed to have a circular shape. The positioning pin holes 16*a*' and 16*c* are designed to have an elliptical shape to ensure sufficient amounts of positioning margins in the relative positions among the base plate 6, the spacer plate 82, the channel-forming plates 81, the support plate 13, the diaphragm 3, the restrictor plate 10, the pressure chamber plate 11, and the orifice plate 12.

The base plate 6 mounted with the piezoelectric elements 4, and the spacer plate 82, the channel-forming plates 81, the support plate 13, the diaphragm 3, the restrictor plate 10, the pressure chamber plate 11, and the orifice plate 12 are assembled together into the multi-nozzle ink-jet print head 100 with the positioning pin holes 16*b* of the plates 82, 81, 13, 3, 10, 11, and 12 being lined up with the positioning pin hole 16*a* of the base plate 6 and with the positioning pin holes 16*c* of the plates 82, 81, 13, 3, 10, 11, and 12 being lined up with the positioning pin hole 16*a*' of the base plate 6. Thus, relative positions between the base plate 6 and the spacer plate 82, the channel-forming plates 81, the support plate 13, the diaphragm 3, the restrictor plate 10, the pressure chamber plate 11, and the orifice plate 12 are at prescribed conditions with respect to the positions of the positioning pin holes 16*a* and 16*a*'.

According to the present embodiment, the top surfaces 18 of the piezoelectric elements 4 are precisely positioned on the base plate 6 relative to the positioning pin holes 16*a*. Accordingly, the manifold 8 in the channel-forming plates 81, the openings 17*a* and 17*b* in the support plate 13, the vibration areas 30 in the diaphragm 3, the restrictor channels 7 in the restrictor plate 10, the pressure chambers 2 in the pressure chamber plate 11, and the orifices 1 in the orifice plate 12 can be positioned precisely relative to the top surfaces 18 of the piezoelectric elements 4 as shown in FIG. 2A.

In the ink-jet print head 100 having the above-described structure, ink flows from an ink tank (not shown) through the manifold 8, the restrictor channel 7, and the pressure chamber 2, toward the orifice 1.

During a waiting mode for printing, electric signals are continuously applied to the external electrodes 14*a* and 14*b* of each piezoelectric element 4. An electric potential difference continuously occurs between the external electrodes 14*a* and 14*b*. Accordingly, the piezoelectric element 4 is normally in its expanding state. When print signals are applied to the input signal terminals 5*a* and 5*b* for some piezoelectric element 4, no electric potential difference occurs between the external electrodes 14*a* and 14*b*. As a result, the piezoelectric element 4 shrinks to restore its original shape, and the oscillating area 30 of the diaphragm 3 displaces in a direction away from the orifice 1. As a result, ink is supplied into the corresponding pressure chamber 2, via the corresponding restrictor channel 7, from the manifold 8. When the print signals are turned OFF, the election potential difference occurs again between the external electrodes 14*a* and 14*b*, and the piezoelectric element 4 expands. The oscillating area 30 of the diaphragm 3 displaces toward the orifice plate 1. As a result, an ink droplet is ejected from the pressure chamber 2 through the orifice 1.

Next, the manufacturing procedure for manufacturing the ink-jet print head 100 will be described below with reference to FIGS. 5A–5C. It is noted that the dimensions used in the description below are merely one example, but can be changed according to the widths of original piezoelectric element bars (to be described later) and the number of piezoelectric elements 4 desired to be integrated in a row.

Figure 5A:
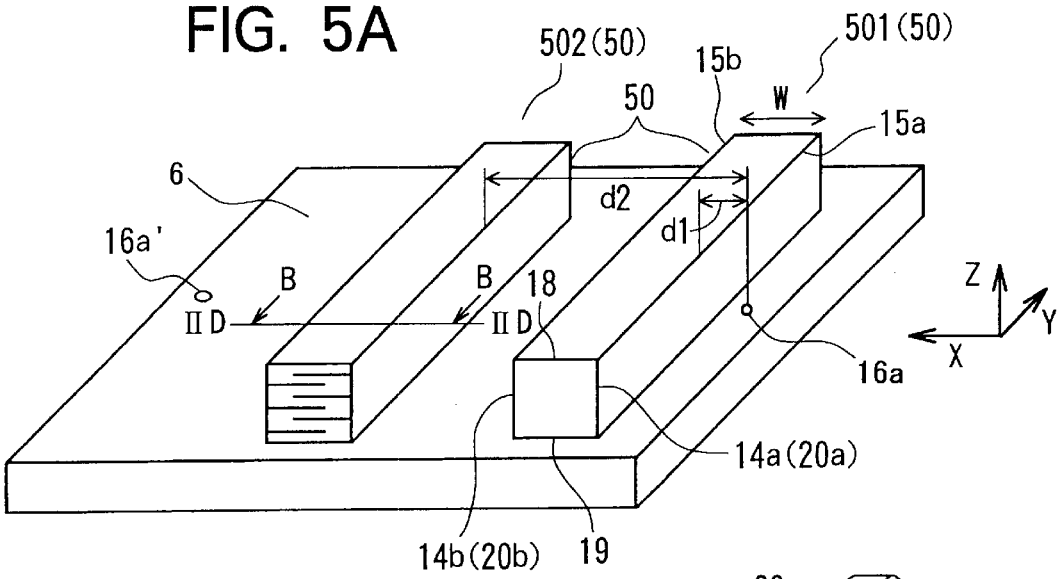
FIGS. 5A through 5C are perspective views showing the manufacturing processes according to the embodiment, in which FIG. 5A show a piezoelectric element bar-fixing process.

First as shown in FIG. 5A, bar- or rod-shaped piezoelectric elements 50 (which will be referred to as "original piezoelectric element bar 50" hereinafter) having a width W of 1.4 mm, for example, and a number equal to the nozzle rows are arranged in rows on the base plate 6. In this example, two original piezoelectric element bars 50 are arranged on the base plate 6.

Each original piezoelectric element bar 50 is oriented so that its lengthwise direction extends parallel to the predetermined direction Y and its widthwise direction extends parallel to the predetermined direction X. The two original piezoelectric element bars 50 are arranged in line along the predetermined direction X.

Each original piezoelectric element bar 50 is of a laminated type, in which the plurality of piezoelectric element units 40 and the internal electrodes 42 are laid one on another as shown in FIG. 2D. Each original piezoelectric element bar 50 is provided with the pair of external electrodes 14*a* and 14*b* at their side surfaces 20*a* and 20*b*. The vertical cross-section of each original piezoelectric element bar 50, taken along a line IID—IID in FIG. 5A as viewed from an arrow B, has the same structure as shown in FIG. 2D and has its corners 15*a* and 15*b* being not yet cut. Each original piezoelectric element bar 50 is mounted on the base plate 6 so that its bottom surface 19 will contact the surface of the base plate 6 and so that its top surface 18 will face upwardly.

Bach original piezoelectrtc element bar 50 is positioned so that the central area of the original piezoelectric element bar 50 along its lengthwise direction (direction Y) is located an distant from the positioning pin hole 16*a* by a predetermined corresponding amount along the predetermined direction X. Each original piezoelectric element bar 50n (where n=1 or 2) is positioned so that its side surface 20*a,* where the external electrode 14*a* is provided, is distant from the positioning pin hole 16*a* by a corresponding predetermined distance dn (where n−1 or 2) in the predetermined direction X. For example, an original piezoelectric element bar 501 (50) for providing a first nozzle row is positioned so that its side surface 20*a* is distant from the positioning pin hole 16*a* by a predetermined distance d1 in the predetermined direction X. The other original piezoelectric element bar 502 (50) for providing a second nozzle row is positioned so that its side surface 20*a* is distant from the positioning pin hole 16*a* by another predetermined distance d2 in the predetermined direction X.

Each original piezoelectric element bar 50 is positioned on the base plate 6 using a special positioning jig (not shown) with a certain degree of precision. The original piezoelectric element bar 50 is made of ceramics, and has already been deformed during its sintering process. Accordingly, the original piezoelectric element bar 50 cannot be positioned with great precision on the base plate 6.

Each original piezoelectric element bar 50 is bonded to the surface of the base plate 6 via adhesive. That is, the bottom surface 19 of each original piezoelectric element bar 50 is bonded to the surface of the base plate 6 via adhesive. Thus, each original piezoelectric element bar 50 is fixed to the base plate 6.

Figure 5B:
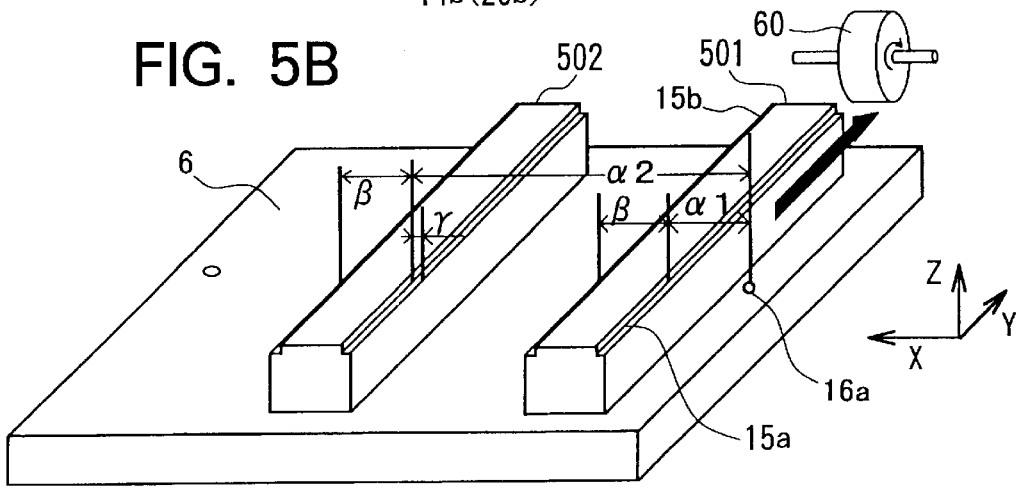
Figure 5C:
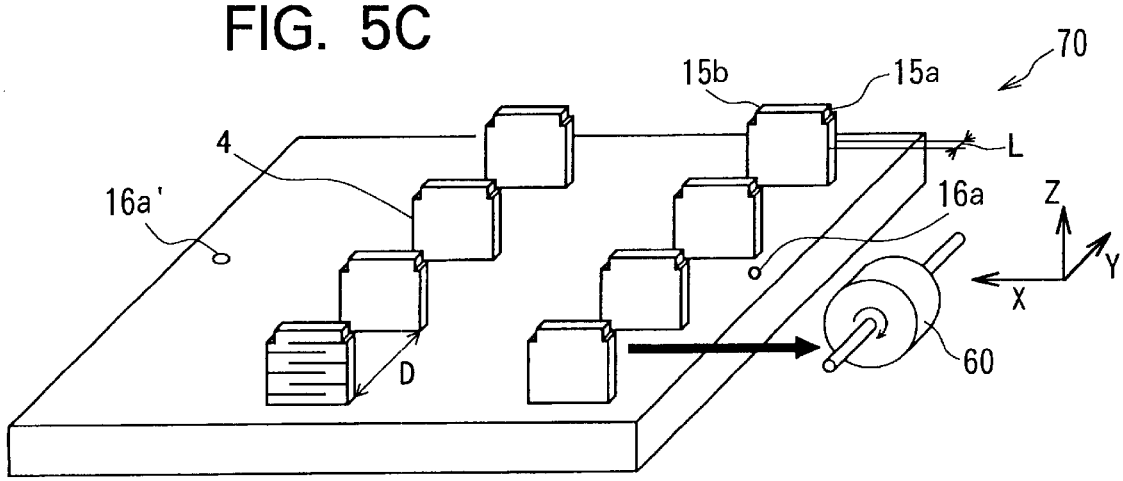

After the original piezoelectric element bars 50 are thus fixed to the base plate 6, as shown in FIG. 5B, a corner cutting process is performed on the corners 15*a* and 15*b,* of each original piezoelectric element bar 50, which are defined between the top surface 18 and the side surfaces 20*a* and 20*b* where the external electrodes 14*a* and 14*b* are provided.

The corner cutting process is performed for the reasons described below.

The original piezoelectric element bar 50 is made of ceramics, and therefore has relatively large errors in its external dimensions. It is necessary, however, to produce each piezoelectric element 4 so that its top surface 18 of a predetermined width β will be located in the corresponding opening 17*a* with the spaces of widths b1 and b2 in the predetermined amounts being formed in both sides of the piezoelectric element 4 as shown in FIGS. 2A, 2B. 3, and 4. In order to satisfy this demand, the original piezoelectric element bar 50 is produced to have the width W that is relatively greater than the predetermined width β. By cutting the corners 15*a* and 15*b* of this original piezoelectric element bar 50 to proper amounts, it is possible to produce the top surface 18 that has the predetermined width β and that is located in the corresponding elongated opening 17*a* with the spaces being formed with widths b1 and b2 of the predetermined amounts.

The corners 15*a* and 15*b* are cut by a dicing saw 60 using the positioning pin hole 16*a* as a reference position. More specifically, the dicing saw 60 is controlled by a numerical control (NC) processing machine (not shown) to move linearly in the direction Y along each of the corners 15*a* and 15*b* on each original piezoelectric element bar 50. The dicing saw 60 is controlled to move at a level, which is upper than and distant from the surface of the base plate 6 by a predetermined amount in the predetermined direction Z, so as to provide a desired amount of cut depth.

In order to cut the corner 15*a* on the first original piezoelectric element bar 501, the dicing saw 60 is controlled to move on a linear movement path that extends in the direction Y and that is distant from the positioning pin hole 16*a* by an amount of α1 In the predetermined direction X. In order to cut the corner 15*b* on the first original piezoelectric element bar 501, the dicing saw 60 is controlled to move an another linear movement path that extends in the direction Y and that is distant from the positioning pin hole 16*a* by an amount of α1+β in the predetermined direction X. In order to cut the corner 15*a* on the second original piezoelectric element bar 502, the dicing saw 60 is controlled to move on still another linear movement path that extends in the direction Y and that is distant from the positioning pin hole 16*a* by an amount of α2 in the predetermined direction X. In order to cut the corner 15*b* on the second original piezoelectric element bar 502, the dicing saw 60 is controlled to move on another linear movement path that extends in the direction Y and that is distant from the positioning pin hole 16*a* by an amount of α2+β in the predetermined direction X. As a result, the top surface 18 of the first original piezoelectric element bar 501 will be positioned as distant from the positioning pin hole 16*a* by the predetermined distance α1, and will have the predetermined width β. The top surface 18 of the second original piezoelectric element bar 502 will be positioned as distant from the positioning pin hole 16*a* by the predetermined distance α2, and will have the predetermined width β.

The predetermined width β is a desired value of the width of the top surface 18 (FIG. 4) to be bonded to the diaphragm 3. The value α1 is selected relative to the distance d1 so as to allow the top surface 18 of the first row 501 to be positioned precisely relative to the corresponding elongated openings 17*a* in the support plate 13 to form the spaces with widths b1 and b2 of the predetermined amounts. The value α2 is selected relative to the distance d2 so as to allow the top surface 18 of the second row 502 to be positioned precisely relative to the corresponding elongated openings 17*a* to form the spaces with widths b1 and b2 of the predetermined amounts.

In the present example, the value β is set to 1.0 mm, and each value αn (n=1 or 2) is set to a value, in relation to the corresponding value dn (n=1 or 2), so that each corner 15*a,* 15*b* on each original piezoelectric element bar 50n will be cut at a corner cut width γ of about 0.2 mm, that is, about 1/7 of the width W (1.4 mm in this example) of each original piezoeleotric element bar 50.

It is noted that each value αn (n=1 or 2) should preferably be set to α value, in relation to the corresponding value dn (n=1 or 2), so as to attain the corner cut width γ in a range of about 1/10 to about 1/7 of the width W (1.4 mm in this example) of the original piezoelectric element bar 50. More preferably, each value αn (n=1 or 2) should preferably be set to such a value that will attain the corner cut width γ of about 1/7 the width W.

Errors, of about 0.04 mm, possibly exist in the width W of each original piezoelectric element bar 50n. Errors, of about 0.05 mm, possibly exist in the position of each original piezoelectric element bar 50n on the base plate 6.

Assume now that a value αn (n=1 or 2) is selected to attain the corner cut width γ of less than 1/10 of the width W. In this case, when the dicing saw 60 is controlled to move at a linear movement path that is distant from the positioning pin hole 16*a* by the distance αn, the dicing saw 60 will possibly fail to contact the original piezoelectric element bar 50n due to the above-described possibly-existing errors. The dicing saw 60 will fail to cut the corner 15*a* on the original piezoelectric element bar 50n. Considering these possibly-existing errors, it is preferable to select the value αn (n=1 or 2) to attain the corner cut width γ of about 1/7 of the width W.

It is noted, however, that the value αn (n−1 or 2) should not be selected to attain the corner cut width γ of greater than about 1/7 of the width W. Assume now that the value αn (n=1 or 2) is selected to attain the corner cut width γ of greater than 1/7 of the width W. In this case, when the dicing saw 60 is controlled to move at a linear movement path that is distant from the positioning pin hole 16*a* by the amount αn, the dicing saw 60 will possibly cut the original piezoelectric element bar 50n to a too great amount also due to the possibly-existing errors. The top surface 18 of the piezoelectric element bar 50 will possibly have a width smaller than the desired amount β. This will decrease the area where the piezoelectric element 4 be attached to the diaphragm 3, and therefore will decrease the area where the diaphragm 3 will displace following the deformation of the piezoelectric element 4. This will result in degradation of ink ejection efficiency.

Additionally, it is preferable to select the value αn (where n=1 or 2), relative to the corresponding value dn (where n=1 or 2), to attain the corner cut width γ of less than or equal to a dicing width, that is, the blade width of the dicing saw 60. In this example, the value αn (where n=1 or 2) is selected to attain the corner cut width γ of 0.2 mm when the dicing saw 60 with the blade width of 0.3 mm is used. In this case, it is possible to complete the corner-cutting process for each corner 15*a*, 15*b* only in a single movement operation of the dicing saw 60. Further, the dicing process can be simplified by performing both the corner-cutting process of FIG. 5B and a piezoelectric-element dividing process of FIG. 5C (to be described below) by using the same blade for the dicing saw 60. It is unnecessary to change the blade of the saw 60.

Next, each original piezoelectria element bar 50 is divided, along the predetermined direction Y, into four individual piezoelectric elements 4. This dividing process is performed by using a dicing saw, wire saw, or the like.

For example, as shown in FIG. 5C, each original piezoelectric element bar 50 is cut at a predetermined dicing width D so that four piezoelectric elements 4 will be remained as being separated from one another in the predetermined direction Y by an amount equal to the dicing width D. In this example, the dicing width D is equal to the blade width of the dicing saw 60. Accordingly, the original piezoelectric element bar 50 can be cut at the predetermined dicing width D when the dicing saw 60 is moved in the predetermined direction X only once.

In this example, the dicing saw 60 with the blade width of 0.3 mm is used to cut each original piezoelectric element bar 50. Four piezoelectric elements 4 having lengths L of 0.2 mm are produced from each original piezoelectric element bar 50. The distance between each two adjacent piezoelectric elements 4 in the predetermined direction Y is equal to the blade width of 0.3 mm.

In order to perform this dicing process, the dicing saw 60 is controlled by the numerical control (NC) processing machine (not shown) using the positioning pin hole 16*a* as a reference position. The dicing saw 60 is controlled to move along the surface of the base plate 6 in the direction X repeatedly in order to allow the four individual piezoelectric elements 4 to remain at the four separate positions. Thus, the plurality of piezoelectric elements 4 are produced in one to one correspondence with the plurality of nozzles.

In the above description, the dicing width D is equal to the blade width of the dicing saw 60. However, the dicing width D does not need to be equal to the blade width of the dicing saw 60. It is possible to dice the piezoelectric element bar 50 by any desired value of dicing width D by moving the dicing saw 60 more than once to attain the desired amount of dicing width D.

In the manner described above, a driving module 70 is prepared as shown in FIGS. 5C and 2B. The driving module 70 is constructed from the base plate 6 fixedly mounted with the plurality of piezoelectric elements 4.

Then, as shown in FIG. 2B, the spacer plate 82 and the several channel-forming plates 81 are laid one on another by inserting a pin of a special jig through pin holes 16*b* of all these plates and by inserting another pin through the pin holes 16*c* (not shown) of all these plates. After being relatively positioned with one another in this manner, the spacer plate 82 and the several channel-forming plates 81 are bonded together into the manifold-forming assembly 80.

Then, the support plate 13, the diaphragm 3, the restrictor plate 10, the pressure chamber plate 11, and the orifice plate 12 are laid one on another by inserting a pin of a special jig through pin holes 16*b* of all these plates and by inserting another pin through the pin holes 16*c* (not shown) of all these plates. After being relatively positioned with one another in this manner, the support plate 13, the diaphragm 3, the restrictor plate 10, the pressure chamber plate 11, and the orifice plate 12 are bonded together into a chamber plate assembly 90.

Then, the manifold-forming assembly 80 and the chamber plate assembly 90 are mounted over the driving module 70 by inserting a pin of another special jig through the pin hole 16*a* of the base plate 6 and through the pin holes 16*b* of the manifold-forming assembly 80 and the chamber plate assembly 90, and by inserting another pin through the pin hole 16*a*' of the base plate 6 and through the pin holes 16*c* of the manifold-forming assembly 80 and the chamber plate assembly 90. After being relatively positioned in this manner, the manifold-forming assembly 80, the chamber plate assembly 90, and the driving module 70 are bonded together into the multi nozzle ink-jet print head 100. During this bonding process, the top surfaces 18 of all the piezoelectric elements 4 are bonded to the oscillating areas 30 of the diaphragm 3.

By using the manufacturing method described above, it is possible to set the relative positions between the top faces 18 of all the piezoelectric elements 4 and the corresponding openings 17*a* in the support plate 13 accurately to produce the spaces with the widths b1 and b2 of the predetermined amounts. Accordingly, the ejection properties of all the nozzles will become uniform.

According to the already-described conceivable method, the original piezoelectric element bars are cut at their corners 215*a* an a 215*b* before being fixed to the base plate 206. Accordingly, the resultant piezoelectric elements 204 have a high probability of errors in their positions and sizes when they are assembled together with the support plate 213. Contrarily, according to the present embodiment, the corners 15*a* and 15*b* are cut after the original piezoelectric element bars 50 are fixed on the base plate 6 and the corner cutting process is performed with reference to the positioning pin hole 16*a* as a reference position. Accordingly, the resultant top surfaces 18 of the piezoelectric elements 4 will have no errors in their positions and sizes when they are assembled together with the support plate 13.

Figure 4:
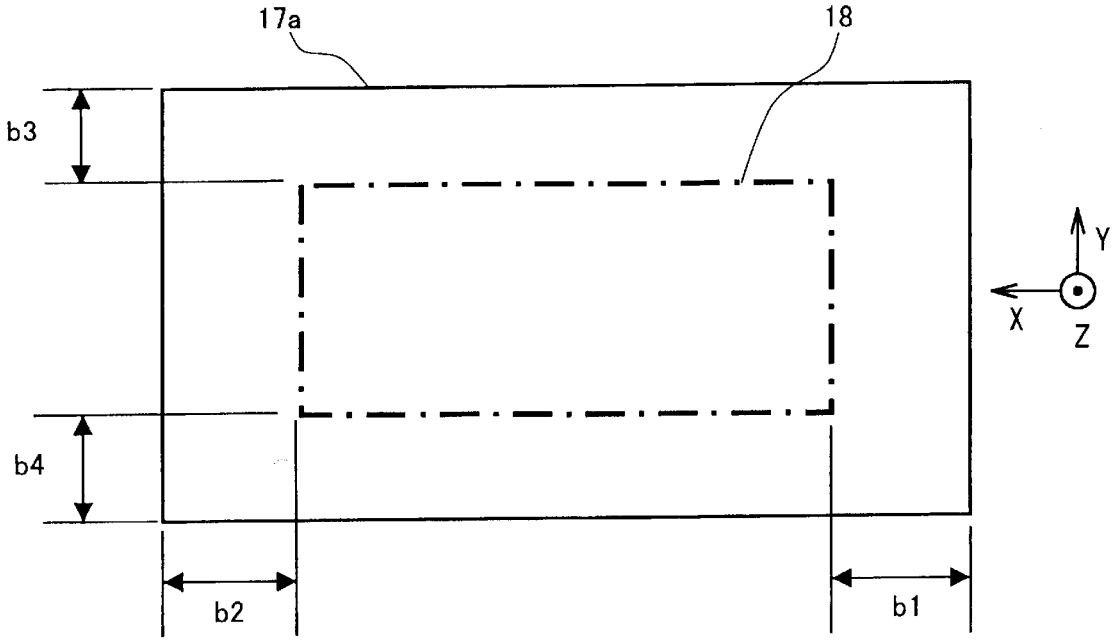
FIG. 4 is an enlarged view of an elongated opening shown in FIG. 3.

It is also important to set, to predetermined amounts, the widths b3 and b4 of spaces that are formed, as shown in FIG. 4, in both sides of the top surface 18 of the piezoelectric element 4 in the opening 17*a* along the predetermined direction Y. It is possible to reduces errors in the sizes of b3 and b4 from the predetermined values also according to the method of the present embodiment. This is because the positioning pin hole 16*a* is used also as a guide for dicing the original piezoelectric element bar 50 into the individual piezoelectric elements 4 during the process of FIG. 5C.

As described above, according to the present embodiment, in order to manufacture the ink-jet print head 100, the piezoelectric element bars 50 are first fixed to the base plate 6. Thereafter, the two corners 15*a* and 15*b* of the piezoelectric element bars 50 are out. Then, the piezoelectric bars 50 are cut to be separated into the individual piezoelectric elements 4. The top faces 18 of all the piezoelectric elements 4 can therefore be positioned and fixed precisely at the desired uniform locations relative to the corresponding individual elongated openings 17*a* in the support plate 13. Accordingly, the ink ejection properties can be made uniform for all the nozzles.

Next, a modification of the ink-jet print head manufacturing method will be described.

Figure 7:
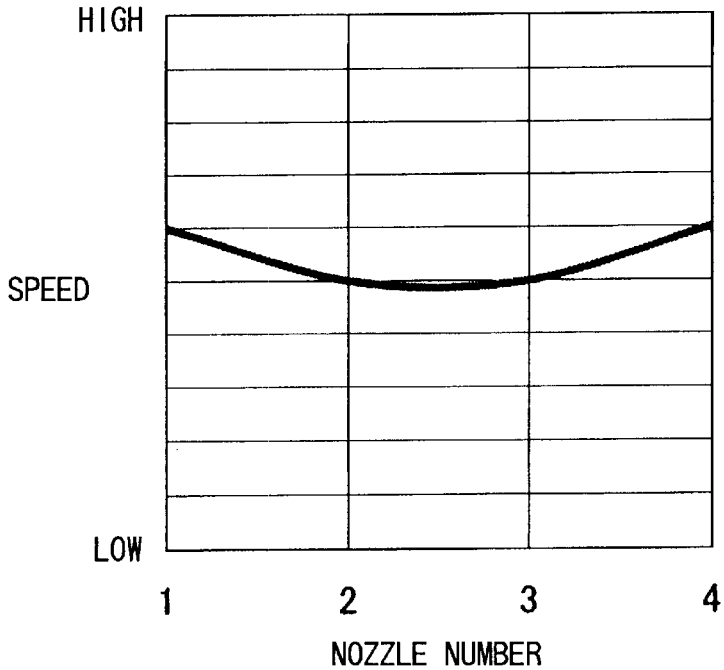
FIG. 7 is a graph showing the End Effect of the nozzles.

Even when the nozzles are manufactured with complete uniformity over the entire nozzle row, it is known from comparing ink ejection amounts of nozzles in the same row that the nozzles eject different amounts of ink at the center and the ends of a single nozzle row. FIG. 7 is a graph showing this phenomenon, which will be referred to as the "End Effect" hereinafter.

In the diagram, the horizontal axis represents the number of nozzles. In this example, one row includes four nozzles from 1 to 4. The vertical axis indicates the droplet velocity (coordinate values are of an arbitrary scale) when the piezoelectric elements are driven at a uniform voltage. The velocity or ink droplets ejected from the No. 2 and No. 3 nozzles in the central area is less than that of ink droplets ejected from the No. 1 and No. 4 nozzles. Since the droplet velocity and the amount of ink ejected have a near-proportional relationship, it is expected that the No. 2 and No. 3 nozzles in the central area also eject a smaller amount of ink.

This phenomenon called the End Effect is generated due to the difference in structure around nozzles in the center of a row and nozzles at the ends (i.e. whether or not nozzles have neighboring nozzles).

Figure 6:
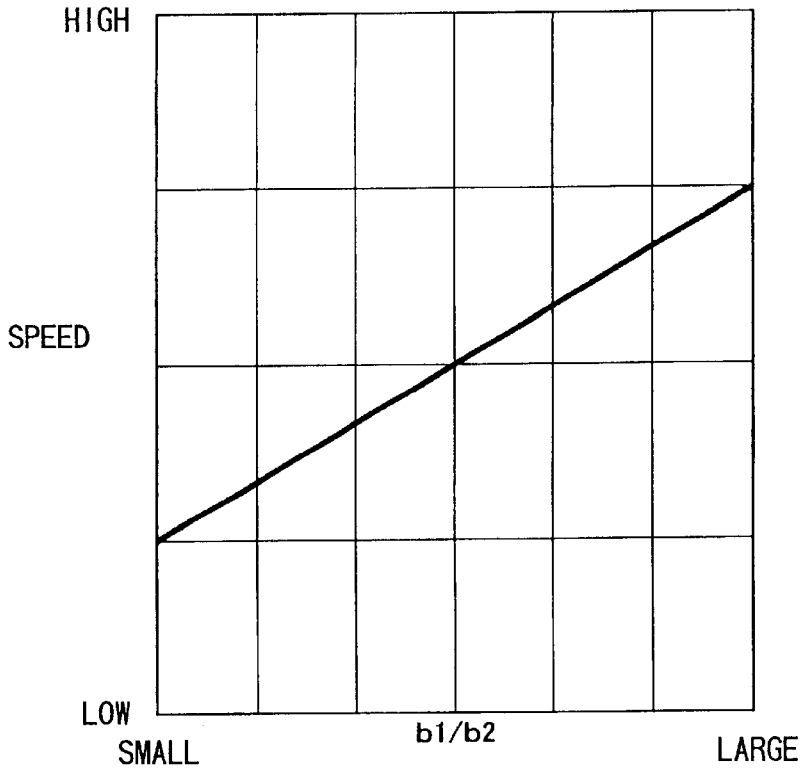
FIG. 6 is a graph showing the relationship between ink droplet velocity and the position of the top portion of the piezoelectric element relative to the elongated opening.

FIG. 6 shows the results of measuring droplet velocity attained by one nozzle under a uniform voltage while changing the ratio of the widths b1 and b2, shown in FIG. 4, by gradually changing the position of the top face 18 (dotted line area) from right to left in the diagram relative to the opening 17*a*.

As can be seen from the diagram, the droplet velocity varies in response to changes in the magnitude of b1/b2, even when applying the same voltage.

This phenomenon occurs because the diaphragm 3 serves as a spring to transmit the deformation of the piezoelectric element 4 to ink in the pressure chamber 2. The parts of the diaphragm 3, which have widths b1 and b2 and which are on the both sides of the area where the diaphragm 3 is bonded to the piezoelectric element 4, perform a spring operation with its spring constant being proportional to the cube of dimension b1 and to the cube of dimension b2. As the widths b1 and b2 change, therefore, the spring magnitude, that is, the magnitude to transmit the deformation of the piezosiectric element 4 to ink, changes, and accordingly the ink ejection speed changes. That is, the ink ejection speed increases as the width b1 increases. It can therefore be understood that it is possible to cancel the End Effect, shown in FIG. 7. by deliberately changing the magnitude of b1/b2 for the nozzles in each nozzle row.

The present modification employs the following method for mitigating the End Effect.

Figure 8A:
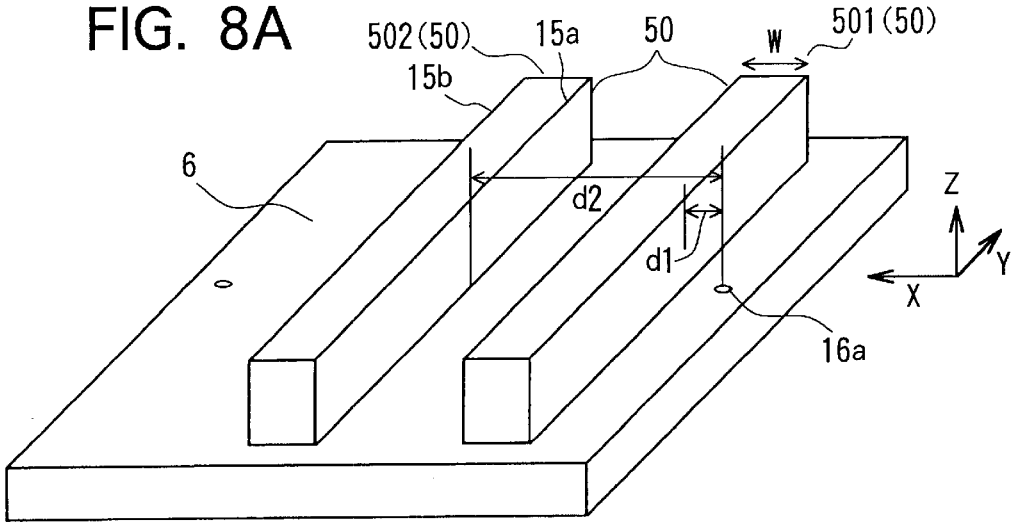
FIGS. 8A through 8C are perspective views showing the manufacturing processes according to a modification, in which FIG. 8A show a piezoelectric element bar-fixing process.

First, as shown in FIG. 8A, the plurality of bar-shaped piezoelectric elements 50, each having the width W, are arranged and fixed by adhesive on the base plate 6 in the same manner as described above for FIG. 5A.

Figure 8B:
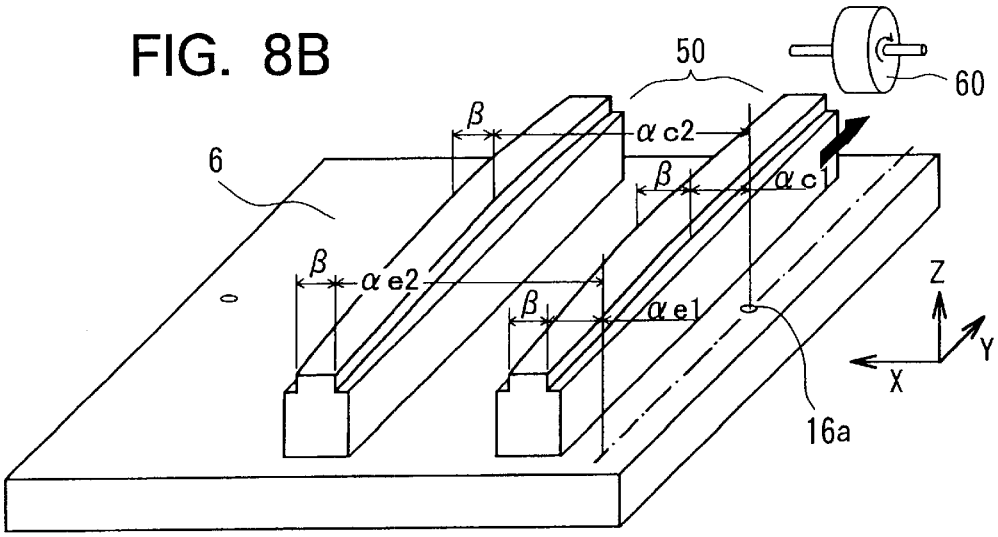

Next, as shown in FIG. 8B, a corner-cutting process is performed using, as a reference position, the positioning pin hole 16*a* in the base plate 6. In this embodiment, the corners 15*a* and 15*b* of each original piezoelectric element bar 50n (n=1 or 2) are cut in a large arc shape so that distance αcn (n=1 or 2) becomes slightly greater than distance αen (n=1 or 2), wherein αcn is defined as a distance, in the predetermined direction X, between the positioning pin hole 16*a* and the top surface 18 of the subject original piezoelectric element bar 50 on its central area in the lengthwise direction Y, and wherein αen is defined as a distance, in the predetermined direction X, between the positioning pin hole 16*a* and the top surface 18 of the subject original piezoelectric element bar 50 on its end areas in the lengthwise direction Y.

In order to cut each corner 15*a*, 15*b* of each original piezoelectric element bar 50n, the dicing saw 60 is controlled by the numerical control (NC) processing machine (not shown) to move in a large arc-shaped movement path whose center position is distant from the positioning pin hole 16*a* by some distance in the predetermined direction X. The distance between the arc center and the positioning pin hole 16*a* and the arc radius are selected so as to allow that the top surface 18 of each bar 50 will be separated from the positioning pin hole 16*a* by the corresponding distance αcn at its central area and by the distance αen at its end areas and so as to allow that the top surface 18 will have a uniform width β over the entire length.

For example, in order to cut the corner 15*a* of the original piezoelectric element bar 501 for the first nozzle, the dicing saw 60 is controlled to move in a large arc-shaped movement path whose center position and radius are selected relative to the distance d1 so that the top surface 18 will be separated from the positioning pin hole 16*a* by the distance αc1 at its central area and will be separated from the positioning pin hole 16*a* by the distance αe1 at its end areas. In order to cut the corner 15*b* of the same original piezoelectric element bar 501, the dicing saw 60 is controlled to move in another large arc-shaped movement path whose center position and radius are selected to allow the top surface 18 to have the uniform width β over its entire length.

Similarly, in order to cut the corner 15*a* of the original piezoelectric element bar 502 for the second nozzle, the dicing saw 60 is controlled to move in still another large arc-shaped movement path whose center position and radius are selected relative to the distance d2 so that the top surface 18 will be separated from the positioning pin hole 16*a* by the distance αc2 at its central area and will be separated from the positioning pin hole 16*a* by the distance αe2 at its end areas. In order to cut the corner 15*b* of the same original piezoelectric element bar 502, the dicing saw 60 is controlled to move in another large arc-shaped movement path whose center position and radius are selected to allow the top surface 18 to have the uniform width β over its entire length.

Thus, in each original piezoelectric element bar 50n, the distance αcn at the center area is made deliberately greater than the distance αen at the end areas. Accordingly, when a plurality of piezoelectric elements 4 are produced based on the thus corner-cut original piezoelectric element bar 50n, the piezoelectric elements 4 will be positioned in the elongated openings 17*a* in the support plate 13 with the ratios b1/b2 at the center area of the corresponding nozzle row being greater than those at the end areas. By making the ratios b1/b2 at the center area greater than those at the end areas, it Is possible to increase the droplet velocity at the center portion without changing the voltage applied thereto. It is possible to cancel the End Effect and achieve the same droplet velocity throughout the entire nozzle row.

Thus, according to the present modification, each original piezoelectric element bar 50 is processed such that the ratios b1/b2 at the center and at the end portions become different.

Figure 8C:
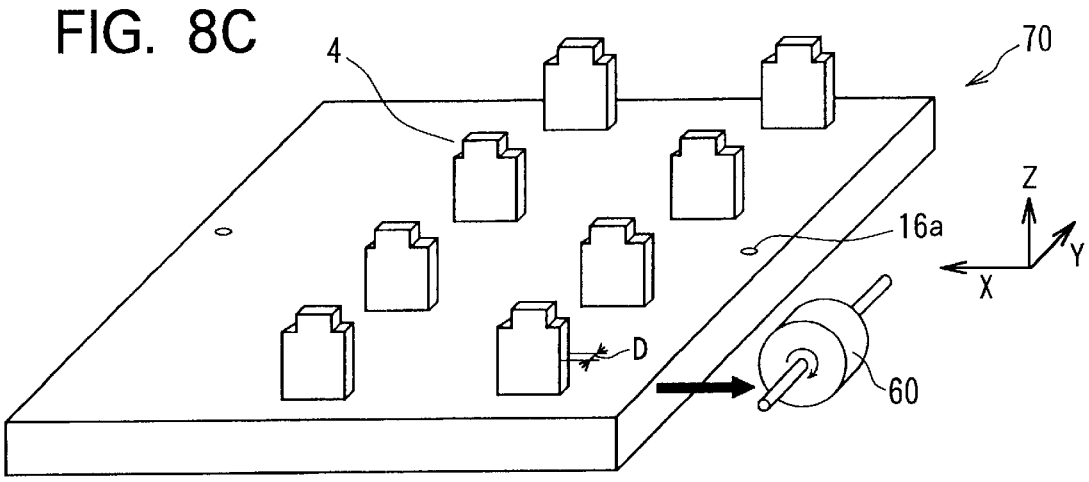

Next, in the same manner as described above for FIG. 5C, each original piezoelectric element bar 50 is cut, using a dicing saw, wire saw, or the like, to be divided into the individual piezoelectric elements 4 as shown in FIG. 8C. As a result, the driving module 70 is obtained. The driving module 70 is assembled together with the plates 80, 13, 3, 10, 11, and 12 in the same manner as in the first embodiment.

With the manufacturing method described above, it is possible to process each original piezoelectric element bar 50 such that the free top surfaces 18 of the resultant piezoelectric elements 4 are positioned relative to the elongated openings 17*a* with dimensions b1/b2 having desired amounts with a high degree of accuracy. It is possible to obtain the ink-jet print head 100 that has uniform ejection properties for all the nozzles in each row.

In the above description, the corner-cutting process is performed by cutting the corners 15*a* and 15*b* of the original piezoelectric element bar 50 in an arc shape. However, the present modification is not limited to this construction.

Figure 9A:
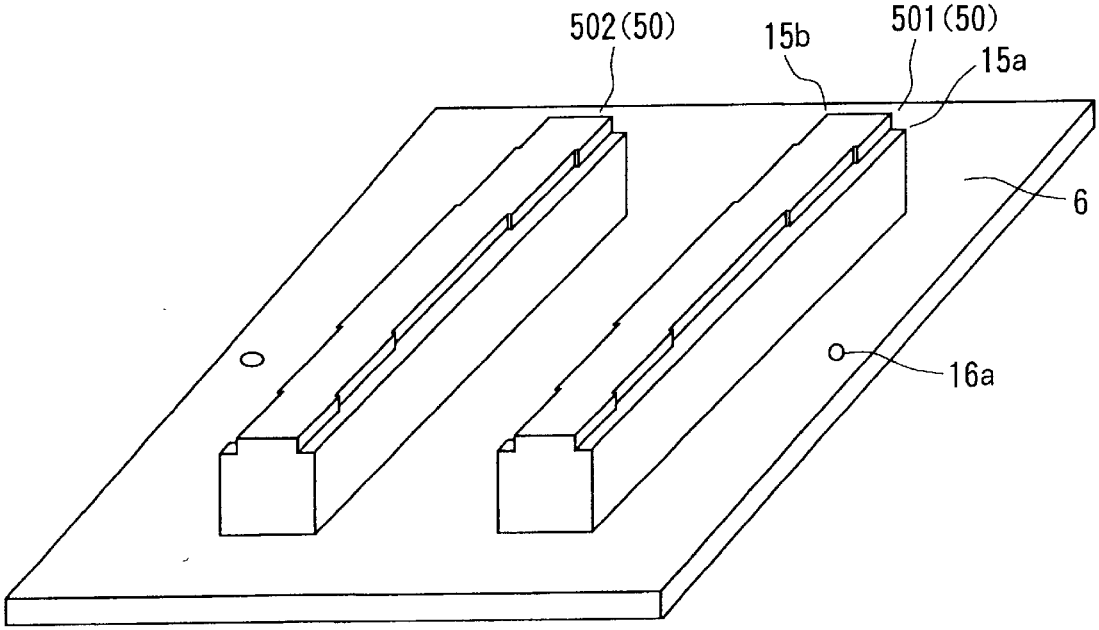
Figure 9B:
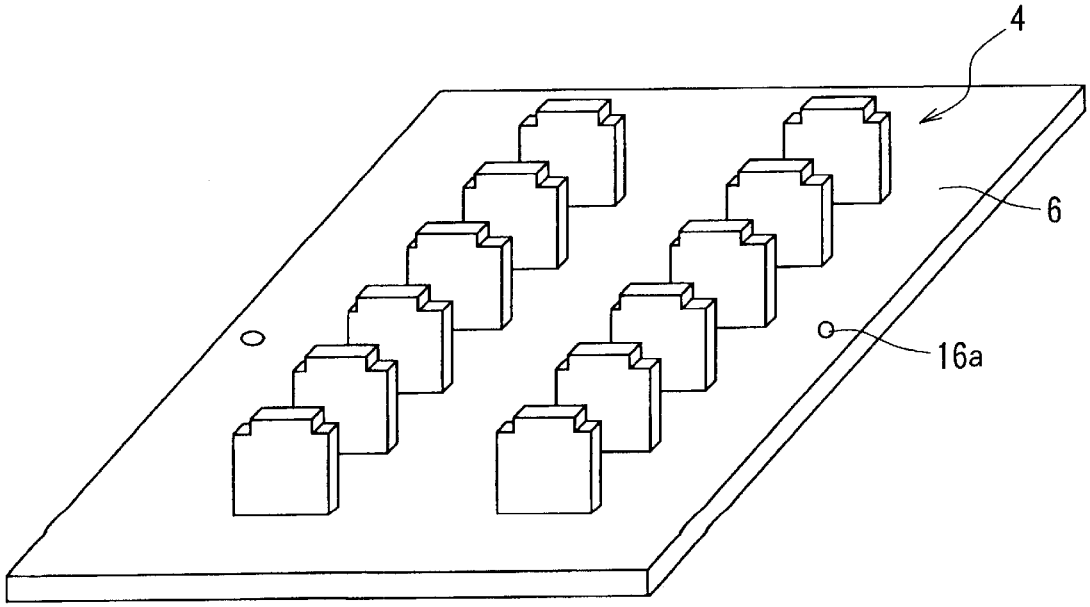

For instance, the same effects can be achieved by cutting a step formation from the end areas inward toward the center area, providing that the ratio b1/b2 at the center area is larger than that at the end areas as shown in FIG. 9A. In order to cut each corner 15*a,* 15*b* of each original piezoelectric element bar 50n as shown in FIG. 9A, the dicing saw 60 is controlled by the numerical control (NC) processing machine to move linearly in the predetermined direction Y while changing the distance, in the predetermined direction X, between the dicing saw 60 and the positioning pin hole 16*a* in a stepwise manner. Thereafter, each original piezoelectric element bar 50 is divided into a plurality of individual piezoelectric elements 4 as shown in FIG. 9B. It Is noted that in this example, the print head is produced to have two nozzle rows with six nozzles in each row. During the corner-cutting process, the distance between the dicing saw 60 and the positioning pin hole 16*a* is changed in three steps from the center area outward toward each end area.

As described above, according to the present modification, the positions of the free tops 18 of the piezoelectric elements 4 can be changed arbitrarily according to ejection properties of the same. Accordingly, the ink ejection properties can be made uniform for all the nozzles. Especially by controlling the dicing saw to move in the arc-shaped movement path, it is possible to change the positions of the free tops 18 over the entire length of the piezoelectric element bar through a single dicing saw moving operation.

Figure 10A:
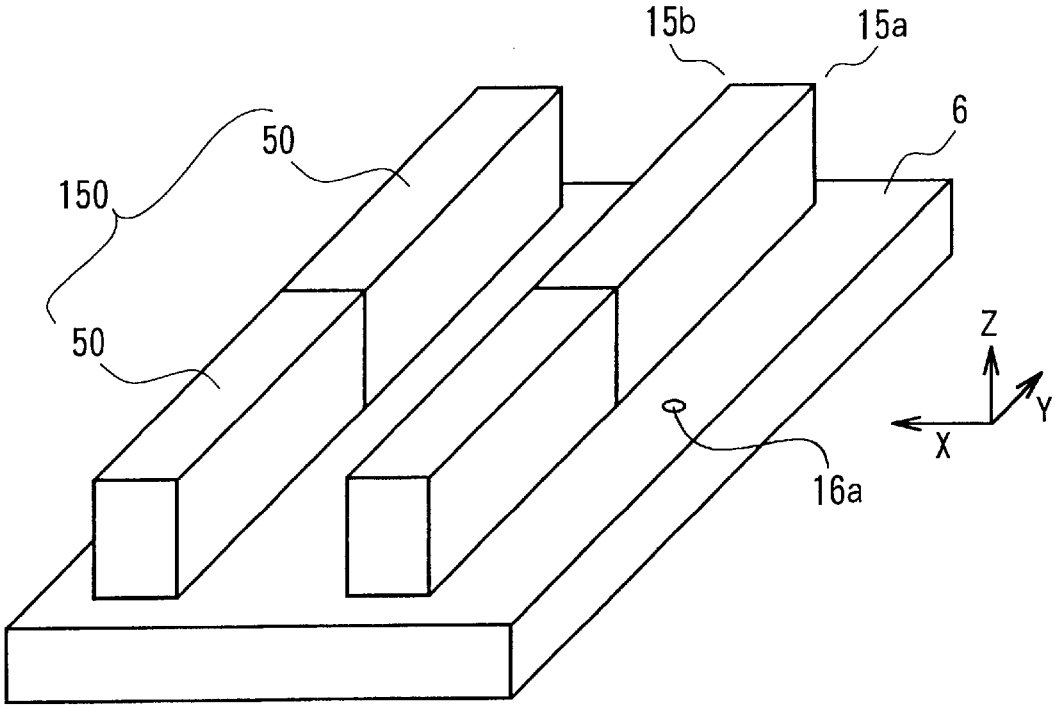

Next, another modification of the method of manufacturing the ink-jet print head 100 will be described with reference to FIGS. 10A–10B.

A recent trend in ink-jet print heads is to increase the number of nozzles per row. In this case, the length of the original piezoelectric element bar 50 may be restricted in order to minimize distortion of the piezoelectric element bar during manufacturing. With consideration for this restriction, according to the present modification, two original piezoelectric element bars 50 are arranged in line along the predetermined direction Y to produce an extended piezoelectric element bar 150 as shown in FIG. 10A. The thus produced extended piezoelectric element bar 150 forms a single row of nozzles. It is possible to manufacture the ink jet print head 100 by arranging a plurality of extended piezoelectric element bars 150 in the predetermined direction X as shown in FIG. 10A and by subjecting the extended piezoelectric element bars 150 to any methods described already with reference to FIGS. 5A–5C, 8A–8C, and 9A–9B.

That is, using the positioning pin hole 16*a* as a positioning reference, the corner cutting process is performed using the dicing saw 60 or the like to cut two corners 15*a* and 15*b* of each extended piezoelectric element bar 150. When employing the method of FIG. 5B, the dicing saw 60 is moved so that the distance an between the top surface 18 of each extended piezoelectric element bar 150n (n=1 or 2) and the positioning pin hole 16*a* will be uniform across the entire length of the subject extended piezoelectric element bar 150. When employing the method of FIG. 8B or 9A, the dicing saw 60 is moved so that the distance an between the top surface 18 of each extended piezoelectric element bar 150n (n=1 or 2) and the positioning pin hole 16*a* will change for the end and central areas of the subject extended piezoelectric element bar 150 in its lengthwise direction Y. Thereafter, each extended piezoelectric element bar 150 is divided into a plurality of individual piezoelectric elements 4 as shown in FIG. 5C, 8C, or 9B.

Figure 10B:
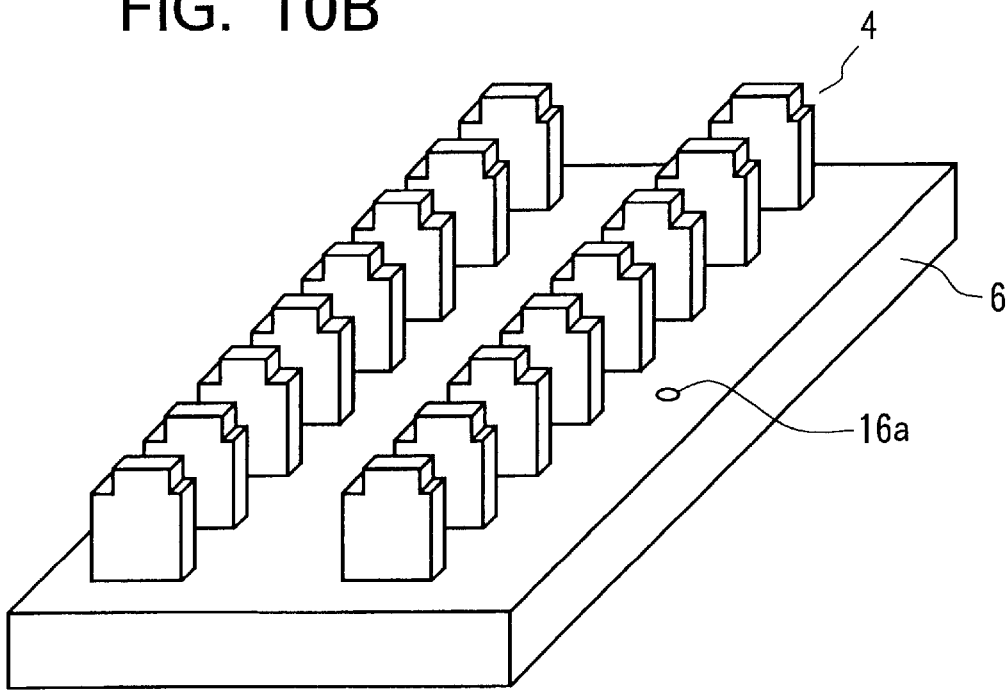

FIG. 10B shows an example where the corners 15*a* and 15*b* of each extended piezoelectric element bar 150 are cut using the method of FIG. 8B and then each extended piezoelectric element bar 150 is diced into the individual piezoelectric elements 4 as shown in FIG. 8C.

Thus, according to the present modification, by arranging a plurality of original piezoelectric element bars 50 for one row of nozzles, it is possible to increase the number of nozzles per row. It is possible to easily increase the length of the nozzle row to form a large number of nozzles per row, even when the length of each original piezoelectric element bar is limited due to its manufacturing conditions. Further, the ink ejection properties can be made uniform for all the nozzles in the row.

While the invention has been described in detail with reference to the specific embodiment and modifications thereof, it would be apparent to those skilled in the art that various changes and modifications may be made therein without departing from the spirit of the invention.

Figure 11A:
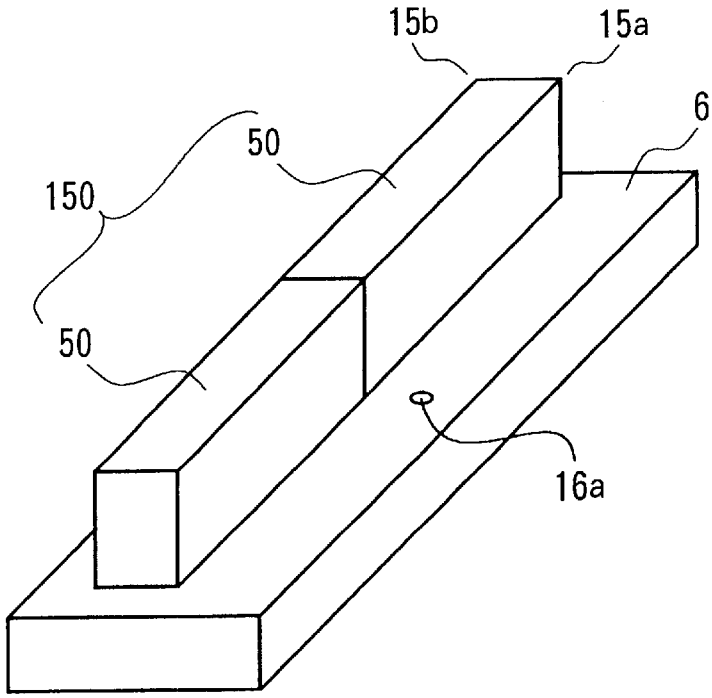
Figure 11B:
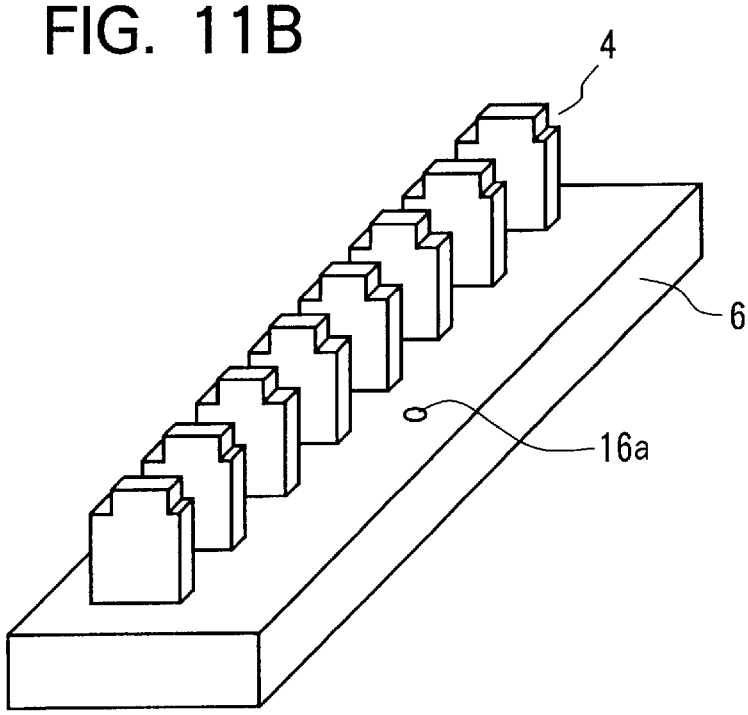

For example, in the above-described embodiment and modifications, a plurality of nozzle rows are provided in the ink-jet print head 100. However, the present invention can also be applied to a line head or the like that has a single nozzle row, in which a plurality of nozzles are aligned. For example, the method of the modification of FIGS. 10A–10B can be applied to manufacture a line head with a single nozzle row as shown in FIGS. 11A and 11B.

While any of the manufacturing methods of the above-described embodiment and modifications are effective to manufacture ink jet print heads using any types of piezoelectric element. However, those methods are particularly effective for manufacturing the ink jet print head 100 that uses the d33-type multi-layer piezoelectric elements 4. The d33-type multi-layer piezoelectric elements 4 can achieve a large resonant frequency with a small height, and can therefore be made small and can be driven at a high frequency. With their small size, a large number of piezoelectric elements 4 can be integrated in one print head.

In the above-described embodiment and modifications, the corners 15*a* and 15*b* are cut after the original piezoelectric element bars 50 are attached to the base plate 6 and the corner cutting operation is performed while referring to the positioning pin hole as a reference position. In the conceivable method, because a grinder is pressed against each corner 215*a,* 215*b,* the corner 215*a,* 215*b* is beveled. In the above-described embodiments, the dicing saw 60 is used to cut the corner 15*a,* 15*b,* and therefore the corner 15*a,* 15*b* is cut into the rectangular shape. However, the tool used for cutting the corners is not limited to the dicing saw. It is possible to use any tools including the grinder as long as the corner-cutting operation is performed using that tool after the original piezoelectric element bar 50 is fixed to the base plate 6 and as long as the movement of the tool is controlled while referring to the pin hole 16*a* as a reference position. Accordingly, the shape of the cut on the corner 15*a,* 15*b* cannot be limited to the rectangular shape, but can be changed to any shapes including the beveled shape.

In the above-described embodiment and modifications, the same reference position 16*a* is used for being referred to as a reference position during all the processes of the piezoelectric element bar arranging-and-bonding process (FIGS. 5A, 8A, 9A, 10A, and 11A), the corner-cutting process (FIGS. 5B, 8B, 9A, 10B, and 11B), the piezoelectric element-dividing process (FIGS. 5C, 8C, 9B, 10B, and 11B), and the ink jet print head assembling process (FIG. 2B). However, it may be possible to refer to different reference positions defined on the base plate 6 during at least one of the piezoelectric element bar arranging-and-bonding process, the corner-cutting process, the piezoelectric element-dividing process, and the ink jet print head assembling process. For example, the same reference position may be used during the corner-cutting process and the piezoelectric element-dividing process, but other different reference positions may be used during the piezoelectric element bar arranging-and-bonding process and the ink jet print head assembling process.

In the modifications of FIGS. 10A–11B, each extended original piezoelectric element bar 150 is comprised from two original piezoelectric element bars 50. However, each extended original piezoelectric element bar 150 may be comprised from more than two original piezoelectric element bars 50.

In the above-described embodiment and modifications, the spacer plate 82 is provided as a part of the manifold-forming assembly 80. However, the spacer plate 82 may not be provided as a part of the manifold-forming assembly 80. The manifold-forming assembly 80 may be constructed only from the several channel-forming plates 81. In this case, the spacer plate 82, the channel-forming plates 81, and the chamber plate assembly 90 may be mounted on the driving module 70 so that the spacer plate 82 is positioned between the channel-forming plates 81 and the driving module 70. Then, all the spacer plate 82, the channel-forming plates 81, the chamber plate assembly 90, and the driving module 70 are bonded together into the ink-jet print head 100.

In the above-described embodiment and modifications, during the manufacturing process of the ink-jet print head 100, the base plate 6 is oriented horizontally with the predetermined direction Z, normal to the base plate 6, extending vertically upwardly. However, the base plate 6 can be oriented in any posture during the manufacturing process of the ink-jet print head 100.

What is claimed is:

1. A method of manufacturing an ink jet print head which has one or more nozzle rows, each nozzle row including a plurality of nozzles, the ink jet print head having a diaphragm that forms at least a part of a wall defining a pressure chamber storing ink for each nozzle, a wall portion that defines a remaining part of the wall defining the pressure chamber for each nozzle, that defines an ink channel for supplying ink to the pressure chamber, and that defines an orifice for ejecting ink droplets from the pressure chamber, a piezoelectric element, provided for each nozzle, to allow, in response to electric signals, the diaphragm to generate a pressure variation within the corresponding pressure chamber, thereby causing an ink droplet to be ejected from the pressure chamber through the corresponding orifice, and a base plate, on which all the piezoelectric elements, the wall portion, and the diaphragm are mounted, the method comprising the steps of:

arranging, while referring to a first reference position that is defined on a base plate, one or more original piezoelectric element bars, in one or more rows, on a surface of the base plate, and bonding the one or more, original piezoelectric element bars on the surface of the base plate, the number of the one or more rows corresponding to the number of one or more nozzle rows to be mounted in the ink jet print head, the one or more original piezoelectric element bars being oriented with their lengthwise directions corresponding to an extending direction of each nozzle row and being arranged in their widthwise directions to provide the one or more rows, each row being comprised from at least one original piezoelectric element bar, each original piezoelectric element bar having a top surface for being connected to the diaphragm a pair of side surfaces, on which a pair of external electrodes being attached, and a bottom surface, at which the subject original piezoelectric element bar is bonded with the base plate;

subjecting each original piezoelectric element bar, which is fixed on the base plate, to a corner cutting process by cutting at least one of two corners of the original piezoelectric element bar, while referring to a second reference position that is defined on the base plate, the two corners being defined between its pair of side surfaces and its top surface; and subjecting, after the corner-cutting process, each original piezoelectric element bar, which is fixed to the base plate, to a dividing process by dividing each original piezoeleotric element bar, along its lengthwise direction, into a plurality of individual piezoelectric elements, while referring to a third reference position on the base plate, the number of the individual piezoelectric elements corresponding to the number of nozzles to be provided in each row.

2. A method as claimed in claim 1, further comprising the step of mounting the wall portion and the diaphragm onto the base plate, which is already mounted with the individual piezoelectric elements, while referring to a fourth reference position that is defined on the base plate, and bonding the diaphragm, via an elastic material, to the top surfaces of all the individual piezoelectric elements.

3. A method as claimed in claim 2, wherein the wall portion includes a support portion reinforcing the diaphragm, the support portion being formed with a plurality of openings for the plurality of nozzles in each nozzle row, the diaphragm being exposed through the plurality of openings, and wherein the mounting and bonding step includes a step of bonding a part of each exposed portion of the diaphragm, via the elastic material, to the top surface of the corresponding individual piezoelectric element mounted on the base plate.

4. A method as claimed in claim 1, wherein the second and third reference positions are the same as each other.

5. A method as claimed in claim 4, wherein all the first through third reference positions are the same as one another.

6. A method as claimed in claim 2, wherein the second and third reference positions are the same as each other.

7. A method as claimed in claim 6, wherein all the first through fourth reference positions are the same as one another.

8. A method as claimed in claim 1, wherein the corner cutting process is conducted by using a dicing saw, and wherein during the corner cutting process for each original piezoelectric element bar, the dicing saw is moved along the lengthwise direction of the subject original piezoelectric element bar with a distance between the dicing saw and the second reference position being controlled to a corresponding amount, the vertical position of the dicing saw distant from the base plate being fixed to provide a desired cut depth amount on the corner.

9. A method as claimed in claim 8, wherein the dividing process is conducted by using the dicing saw, and wherein during the dividing process, the dicing saw is moved along the widthwise directions of the one or more original piezoelectric element bars and along the surface of the base plate repeatedly, thereby allowing the plurality of individual piezoelectric elements, each having a desired length, to remain on the base plate.

10. A method as claimed in claim 8, wherein during the corner cutting process for each original piezoelectric element bar, the dicing saw is controlled to move along the lengthwise direction of the subject original piezoelectric element bar, while controlling the distance, defined between the dicing saw and the second reference position, to be fixed over the entire length of the subject original piezoelectric element bar.

11. A method as claimed in claim 8, wherein during the corner cutting process for each original piezoelectric element bar, the dicing saw is controlled to move along the lengthwise direction of the subject original piezoelectric element bar, while controlling the distance, defined between the dicing saw and the second reference position, to change over the entire length of the subject original piezoelectric element bar.

12. A method as claimed in claim 11, wherein during the corner cutting process for each original piezoelectric element bar, the distance, between the dicing saw and the second reference position, is controlled to change gradually over the entire length of the subject original piezoelectric element bar.

13. A method as claimed in claim 12, wherein each original piezoelectric element bar is mounted on the base plate at a position that is distant from the first reference position by a corresponding amount in its widthwise direction, wherein during the corner cutting process for each original piezoelectric element bar, the dicing saw it moved in an arc-shaped movement path with its imaginary central position being defined on the base plate as distant from the second reference position by a corresponding amount in a direction parallel to the widthwise direction of the subject original piezoelectric element bar and with its radius corresponding to the distance between the subject original piezoelectric element bar and the second reference position, the second reference position being the same as the first reference position.

14. A method as claimed in claim 12, wherein during the corner cutting process for each original piezoelectric element bar, the distance, defined between the dicing saw and the second reference position, is controlled to change step by step over the entire length of the subject original piezoelectric element bar from its end portion toward its center portion and then toward its other end portion.

15. A method as claimed in claim 8, wherein each original piezoelectric element bar has a central portion and a pair of opposite end portions along its lengthwise direction, and wherein during the corner cutting process for each original piezoelectric element bar, the dicing saw is moved to cut the at least one corner or the subject original piezoelectric element bar on the central portion by a central cut width and to cut the at least one corner of the subject original piezoelectric element bar on each of the opposite end portions by an end cut width, the central cut width being different from the end cut width.

16. A method as claimed in claim 15, wherein during the corner cutting process for each original piezoelectric element bar, the dicing saw is moved along an arc-shaped movement path that is centered on a location determined relative to the second reference position on the base plate.

17. A method as claimed in claim 15, wherein during the corner cutting process for each original piezoelectric element bar, the dicing saw is moved along a step-shaped movement path that is determined relative to the second reference position on the base plate.

18. A method as claimed in claim 1, wherein the arranging step arranges the one or more original piezoelectric element bars, whose number is equal to the number of the one or more nozzle rows to be mounted in the ink jet print head, into the one or more rows, each row being comprised from a single original piezoelectric element bar.

19. A method as claimed in claim 1, wherein the arranging step arranges two or more original piezoelectric element bars into the one or more rows, each row being comprised from two or more original piezoelectric element bars which are arranged in line in their lengthwise directions.

20. A method as claimed in claim 1, wherein the arranging step arranges a plurality of original piezoelectric element bars, in two or more rows, on the base plate, thereby providing two or more nozzle rows in a multiple nozzle arrangement.

21. A method as claimed in claim 1, wherein each original piezoelectric element bar has a laminated structure wherein a plurality of piezoelectric elements of d33 type are laminated between the top surface and the bottom surface.

22. A method as claimed in claim 9, wherein the cut width at each of the at least one corner on each original piezoelectric element bar is equal to or smaller than a dicing width, at which each original piezoelectric element bar is cut by the dicing saw, the individual piezoelectric elements being remained as being separated from one another in the lengthwise direction of the original piezoelectric element bar by an amount equal to the dicing width.

23. A method as claimed in claim 22, wherein the cut width on each of the at least one corner on each original piezoelectric element bar is equal to about one seventh of a width of the subject original piezoelectric element bar.

24. A method of manufacturing an ink jet print head which has one or more nozzle rows, each nozzle row including a plurality of nozzles, the ink jet print head having a diaphragm that forms at least a part of a wall defining a pressure chamber storing ink for each nozzle, a wall structure that defines an ink channel supplying ink to the pressure chamber for each nozzle, the ink channel including, for each nozzle row, a manifold and a plurality of restrictor channels, the plurality of restrictor channels being in fluid communication with the corresponding manifold and being in fluid communication with the plurality of pressure chambers in the subject nozzle row, each restrictor channel serving as an ink fluid path supplying ink to the corresponding pressure chamber from the corresponding manifold, the wall structure further defining, for each nozzle, an orifice ejecting an ink droplet from the corresponding pressure chamber, a piezoelectric element, provided for each nozzle, to allow, upon application of electric signals, the diaphragm to generate a pressure variation within the corresponding pressure chamber, thereby causing an ink droplet to be ejected from the pressure chamber through the corresponding orifice, the diaphragm being bonded to each piezoelectric element via an elastic material, and a base plate, on which all the piezoelectric elements, the wall structure, and the diaphragm are mounted, the method comprising the steps of:

arranging one or more original piezoelectric element bars, in one or more rows, on the base plate and bonding the one or more original piezoelectric element bars to the base plate, the number of the one or more rows corresponding to the number of one or more nozzle rows to be mounted in the ink jet print head, the one or more original piezoelectric element bars being oriented with their lengthwise directions corresponding to an extending direction of each nozzle row and being arranged in their widthwise directions to provide the one or more rows, each original piezoelectric element bar having a top surface for being connected to the diaphragm and a pair of side surfaces, on which a pair of external electrodes is attached;

subjecting each original piezoelectric element bar, which is fixed on the base plate, to a corner cutting process by cutting, using a dicing saw, at least one of two corners of the original piezoelectric element bar that are defined by its side surfaces and its top surface, while referring to an arbitrary corner-cut reference position that is defined on the base plate; and subjecting, after the corner-cutting process, each original piezoelectric element bar, which is fixed to the base plate, to a dicing process by dividing each original piezoelectric element bar, along its lengthwise direction, into a plurality of individual piezoelectric elements, while referring to an arbitrary dividing reference position that is defined on the base plate, the number of the individual piezoelectric elements corresponding to the number of nozzles in each row.

25. A method as claimed in claim 24, further comprising the step of mounting the wall structure and the diaphragm onto the base plate, which is already mounted with the individual piezoelectric elements, and bonding the diaphragm, via the elastic material, to the top surfaces of all the individual piezoelectric elements.

26. A method as claimed in claim 24, wherein the arbitrary corner-cut reference position is the same with the arbitrary dividing reference position.

27. A method as claimed in claim 24, wherein the arranging step arranges the one or more original piezoelectric element bars, whose number is equal to the number of the one or more nozzle rows to be mounted in the ink jet print head, into the one or more rows, each row being comprised from a single original piezoelectric element bar.

28. A method as claimed in claim 24, wherein the arranging step arranges two or more original piezoelectric element bars into the one or more rows, each row being comprised from two or more original piezoelectric element bars which are arranged in line in their lengthwise directions.

* * * * *